US008287306B2

(12) United States Patent
Daugherty et al.

(10) Patent No.: US 8,287,306 B2
(45) Date of Patent: Oct. 16, 2012

(54) ELECTRICAL CONNECTION SYSTEM THAT ABSORBS MULTI-CONNECTOR POSITIONAL MATING TOLERANCE VARIATION

(75) Inventors: James D. Daugherty, Brookfield, OH (US); Mark D. McCall, Hubbard, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/113,286

(22) Filed: May 23, 2011

(65) Prior Publication Data

US 2012/0003868 A1 Jan. 5, 2012

Related U.S. Application Data

(60) Provisional application No. 61/360,158, filed on Jun. 30, 2010.

(51) Int. Cl.
*H01H 13/60* (2006.01)

(52) U.S. Cl. ..... 439/540.1

(58) Field of Classification Search ..... 439/540.1, 439/247, 248

See application file for complete search history.

(56) References Cited

U.S. PATENT DOCUMENTS

| | | | | | |
|---|---|---|---|---|---|
| 1,909,270 | A | * | 5/1933 | Monroe Guett | 439/538 |
| 4,534,401 | A | * | 8/1985 | Schaumburg et al. | 164/102 |
| 4,573,514 | A | * | 3/1986 | Wolf et al. | 164/4.1 |
| 4,634,204 | A | * | 1/1987 | Detter et al. | 439/347 |
| 4,812,133 | A | | 3/1989 | Fleak et al. | |
| 4,909,748 | A | * | 3/1990 | Kozono et al. | 439/247 |
| 4,984,998 | A | * | 1/1991 | Duncan et al. | 439/352 |
| 5,017,151 | A | * | 5/1991 | Peterson | 439/248 |
| 5,026,298 | A | * | 6/1991 | Brussalis et al. | 439/358 |
| 5,090,920 | A | * | 2/1992 | Casey | 439/540.1 |
| 5,106,325 | A | * | 4/1992 | Robinson et al. | 439/540.1 |
| 5,228,865 | A | | 7/1993 | Douty et al. | |
| 5,236,373 | A | * | 8/1993 | Kennedy | 439/347 |
| 5,257,944 | A | * | 11/1993 | Kennedy | 439/347 |
| 5,328,381 | A | * | 7/1994 | Seymour et al. | 439/247 |
| 5,411,416 | A | * | 5/1995 | Balon et al. | 439/639 |
| 5,591,041 | A | * | 1/1997 | Cecil et al. | 439/352 |
| 5,605,471 | A | * | 2/1997 | Plyler | 439/489 |
| 5,616,048 | A | * | 4/1997 | Myer et al. | 439/398 |
| 5,628,648 | A | * | 5/1997 | Higgins et al. | 439/489 |
| 5,651,689 | A | * | 7/1997 | Plyler et al. | 439/352 |
| 5,681,178 | A | * | 10/1997 | Kunkle et al. | 439/352 |
| 5,910,027 | A | * | 6/1999 | Wayt et al. | 439/489 |
| 5,975,933 | A | * | 11/1999 | Yamaguchi et al. | 439/247 |
| 5,997,358 | A | * | 12/1999 | Adriaenssens et al. | 439/676 |
| 6,030,242 | A | * | 2/2000 | Cunningham et al. | 439/247 |
| 6,068,507 | A | * | 5/2000 | Popa | 439/489 |
| 6,077,101 | A | * | 6/2000 | Garretson et al. | 439/352 |
| 6,176,738 | B1 | * | 1/2001 | Consoli et al. | 439/545 |

(Continued)

*Primary Examiner* — Amy Cohen Johnson
*Assistant Examiner* — Vladimir Imas
(74) *Attorney, Agent, or Firm* — Paul W. Thiede

(57) ABSTRACT

A ganged electrical connection system includes an arrangement defining a plurality of receptacles. A plurality of first connectors is receivably coupled in the plurality of receptacles. A plurality of second connectors is matable to the plurality of coupled first connectors of the arrangement along mating axes. Positional mating tolerance variation associated with the plurality of second connectors in relation to the plurality of coupled first connectors manifested at the plurality of receptacles when the plurality of second connectors are mated to the plurality of coupled first connectors is absorbed by the arrangement. The plurality of the plurality of second connectors mate with the plurality of coupled first connectors in a single unimpeded, uninterrupted mating connection. A ganged electrical system for an electric-type vehicle is also presented.

19 Claims, 14 Drawing Sheets

U.S. PATENT DOCUMENTS 6,394,844 B1 * 5/2002 Frias Valero et al. .... 439/607.07
6,406,192 B1 * 6/2002 Chen et al. ..... 385/56
6,412,986 B1 * 7/2002 Ngo et al. ..... 385/53
6,736,659 B1 * 5/2004 Wu ..... 439/247
6,857,892 B2 * 2/2005 McLauchlan et al. ..... 439/352
6,857,900 B2 * 2/2005 Kleeberger et al. ..... 439/540.1
6,890,200 B1 * 5/2005 Wu ..... 439/247
7,044,751 B2 * 5/2006 Takanashi et al. ..... 439/76.2
7,288,001 B1 * 10/2007 Aekins ..... 439/540.1
7,326,074 B1 * 2/2008 Lim et al. ..... 439/352
7,338,317 B1 * 3/2008 Nagy et al. ..... 439/555
7,347,743 B2 3/2008 Daugherty et al.
7,367,850 B1 * 5/2008 Chang ..... 439/676
7,381,084 B1 * 6/2008 Horn et al. ..... 439/489
7,381,087 B2 * 6/2008 Alvarez ..... 439/540.1
7,399,195 B2 * 7/2008 Kim et al. ..... 439/352
7,470,138 B1 * 12/2008 Chen et al. ..... 439/352
7,559,787 B2 * 7/2009 Shigeta et al. ..... 439/358
7,601,024 B2 * 10/2009 Martich ..... 439/540.1
7,628,628 B2 * 12/2009 Matsuda et al. ..... 439/248
7,682,181 B1 * 3/2010 Jones et al. ..... 439/352
7,744,390 B2 * 6/2010 Tyler et al. ..... 439/157
7,794,247 B2 * 9/2010 Suzuki ..... 439/157
7,815,461 B2 * 10/2010 Oka ..... 439/382
2003/0095395 A1 * 5/2003 Clark et al. ..... 361/796
2004/0235344 A1 * 11/2004 Kleeberger et al. ..... 439/540.1
2004/0248459 A1 * 12/2004 Sian et al. ..... 439/489
2005/0239309 A1 * 10/2005 Scafidi et al. ..... 439/247
2008/0274634 A1 * 11/2008 Kabasawa et al. ..... 439/247

* cited by examiner

ELECTRICAL CONNECTION SYSTEM THAT ABSORBS MULTI-CONNECTOR POSITIONAL MATING TOLERANCE VARIATION

RELATED DOCUMENTS TO APPLICATION

This application claims priority to provisional application U.S. Ser. No. 61/360,158 filed on Jun. 30, 2010. This application is also related to U.S non-provisional application U.S. Ser. No. 13/113,301 entitled "BI-DIRECTIONAL CPA MEMBER TO PREVENT UNMATING OF MULTIPLE CONNECTORS," and U.S. non-provisional application U.S. Ser. No. 13/113,313 entitled "ELECTRICAL CONNECTION SYSTEM HAVING DIELECTRIC SPRING TO ABSORB AXIAL POSITIONAL MATING TOLERANCE VARIATION FOR MULTIPLE CONNECTORS," that are co-owned by the assignee of this application and are incorporated by reference herein. The abovementioned non-provisional applications have been harmoniously filed on the same day of 23 May 2011.

TECHNICAL FIELD

This invention relates to an electrical connection system that absorbs positional mating tolerance variation during mating of connectors in the electrical connection system.

BACKGROUND OF INVENTION

It is known that electrical performance of electrical components in electrical communication with an electrical connection array is, in part, dependent on the quality of the electrical connections contained within the electrical connection array.

In some applications where an electrical connection array is employed, larger than normal tolerances in the positioning of the connection terminations may occur, for example, due to limitations in a manufacturing process used to produce the electrical connection array. Normally, connection array tolerances are controlled tight enough to assure that the mating terminals in the device connection system array interface properly in alignment, such as may occur when there is minimal external strain on a terminal contact interface within the electrical connection array. If undesired larger than normal tolerances are encountered during the mating of connectors in the electrical connection array, misalignment of the connectors may occur that may cause undesired poor quality or faulty electrical connections that may negatively affect the electrical performance of electrical components electrically connected with the electrical connection array. In other circumstances, connectors in the connection system array may not be matable as a result of excessive tolerance variation or may be irrevocably damaged during the mating process due to connector misalignment that may undesirably leave the electrical components inoperative. Additional servicing to repair a damaged electrical connection array may also undesirably increase service costs. Thus, a robust, consistent, smooth mating of connectors in the connection array having mating tolerance variation between the connectors remains desirable. In electrical applications where a large number of connections are required, it may be advantageous to be able to gang some number of connections together in a single arrangement where the connections mate in a single unimpeded mating connection to save time and to allow for ease of assembly.

Thus, what is needed is a reliable, robust electrical connection system that allows for positional mating tolerance variation between multiple connectors in the electrical connection system to be absorbed within the electrical connection system so that repeatable, consistent, and high-quality electrical connections in the electrical connection system are attained when connectors in the electrical connection system are mated while also being unaffected by the number of mating devices and/or the number of terminations within the mating devices in the mating device arrangement.

SUMMARY OF THE INVENTION

In accordance with one embodiment of the invention, a ganged electrical connection system is mated together in a single uninterrupted, unimpeded mating connection. The ganged electrical connection system an arrangement defining a plurality of receptacles and including a plurality of first connectors being receivably coupled in the plurality of receptacles. The plurality of second connectors are matable to the plurality of coupled first connectors of the arrangement along mating axes. The plurality of coupled first connectors have respective floatable movement in the respective plurality of receptacles that absorb the positional mating tolerance variation during mating of the plurality of second connectors to the plurality of coupled first connectors. The floatable movement in the respective plurality of receptacles occurs in at least one of an X-axis and a Y-axis direction about the respective mating axes orthogonal to the respective mating axes in the respective plurality of receptacles. When the positional mating tolerance variation associated with the plurality of second connectors in relation to the plurality of coupled first connectors is manifested at the plurality of receptacles when the plurality of second connectors are mated to the plurality of coupled first connectors the positional mating tolerance variation is absorbed by the arrangement.

In another embodiment of the invention, a method for absorbing positional mating tolerance variation during mating of a plurality of first and a plurality of second connectors in an electrical connection system is presented.

In accordance with yet other embodiments of the invention, a ganged electrical connection system is used in an electric-type vehicle along with a method of using the same is also presented.

BRIEF DESCRIPTION OF THE DRAWINGS

This invention will be further described with reference to the accompanying drawings in which.

DETAILED DESCRIPTION OF THE EMBODIMENTS

Figure 1:
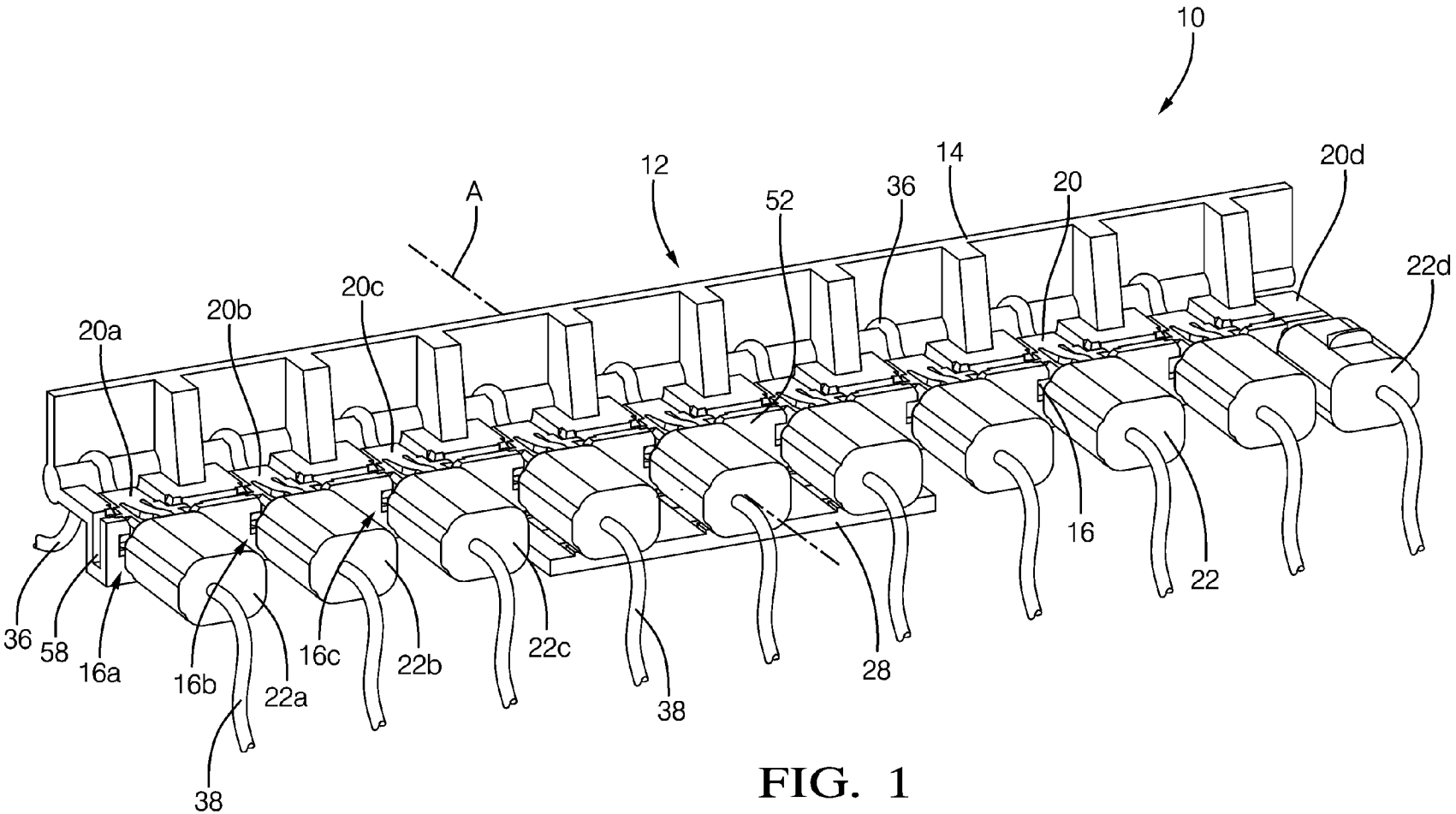
FIG. 1 shows an left-hand, rear-side view of a plurality of first connectors coupled in a support frame forming an arrangement and mated with a plurality of second connectors in an electrical connection system according to the invention.

Electrical components in an electrical system may be electrically joined, or connected in electrical circuits by one or more electrical connection assemblies, or systems. Electrical connection systems may be found in abundance in many industries such as the automotive, marine, and airline industries. In the automotive industry, electrical connector assemblies are used in various types of electrical systems such as bussed electrical centers (BECs), engine compartments, RF communication systems, and the like. In certain electrical system applications, positional mating tolerance variation may be specified between individual sets of connectors in the electrical connection system. Positional mating tolerance variation relates to how closely a set of connector halves in the electrical connection system align as the connector halves are mated. For example, the electrical connection system has increased positional mating tolerance variation when the connectors have more mis-alignment, off-alignment, or mis-registration between the connectors when the connectors are mated. In some electrical applications, inherent positional mating tolerance variation may be understood in a suitable manner so as to be predetermined before the electrical connection system is constructed. Additionally, there may be inherent positional mating tolerance variation for each connector in the ganged electrical connection system. Once the predetermined positional mating tolerance is understood in an electrical application, the electrical connection system may be constructed in a manner to incorporate the assimilation of the predetermined positional mating tolerance variation within the electrical connection system. Consequently, the constructed electrical connection system may assimilate, or absorb the predetermined positional mating tolerance variation for each connector set in the electrical connection system when the connector sets are mated together, regardless of the number of connectors. The electrical connection system may absorb at least a portion of the specified positional mating tolerance variation up to the predetermined positional mating tolerance between each set of connectors during the mating of the more than one set of connectors to ensure an unimpeded, uninterrupted, and smooth, high-quality mating connection of the connectors. Thus, a maximum total amount of possible positional mating tolerance variation that may be assimilated by the electrical connection system is a sum of the individual positional mating tolerance variations for each set of connectors disposed in the electrical connection system. The predetermined positional mating tolerance variation may also incorporate structural size of the individual connectors that may vary over time when the connectors are manufactured. "Float" is constructed in to the electrical connection system to absorb the predetermined positional mating tolerance variation. "Float" is a term used in the electrical connection arts that means to drift or move gently, and as used herein, applies to a connector in the electrical connection system that is allowed to move gently while not generally being fixedly secured in one place.

Figure 5:
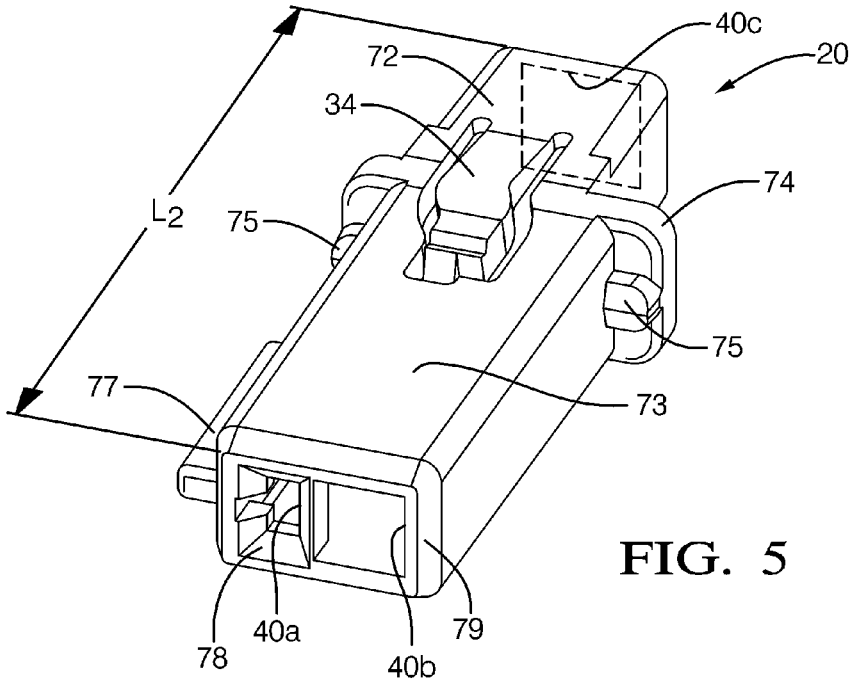
FIG. 5 shows a rear side, right-hand view of a first connector of the electrical connection system of FIG. 1.
Figure 6:
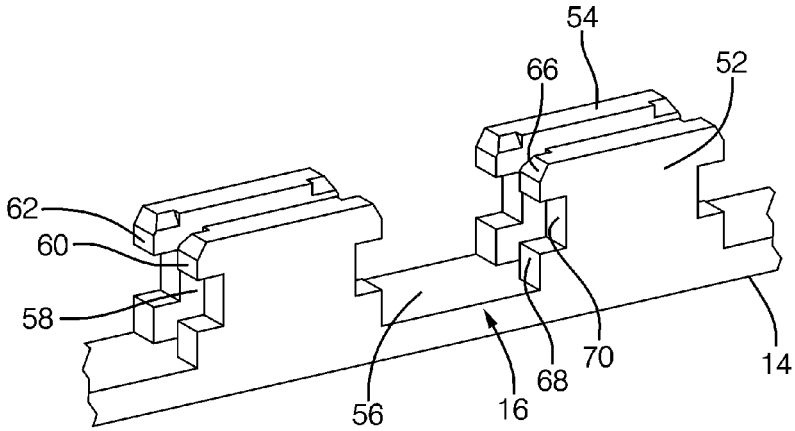
FIG. 6 shows a portion of the first and a second rail of the arrangement of FIG. 3, with the first connectors not coupled in the receptacles.
Figure 7:
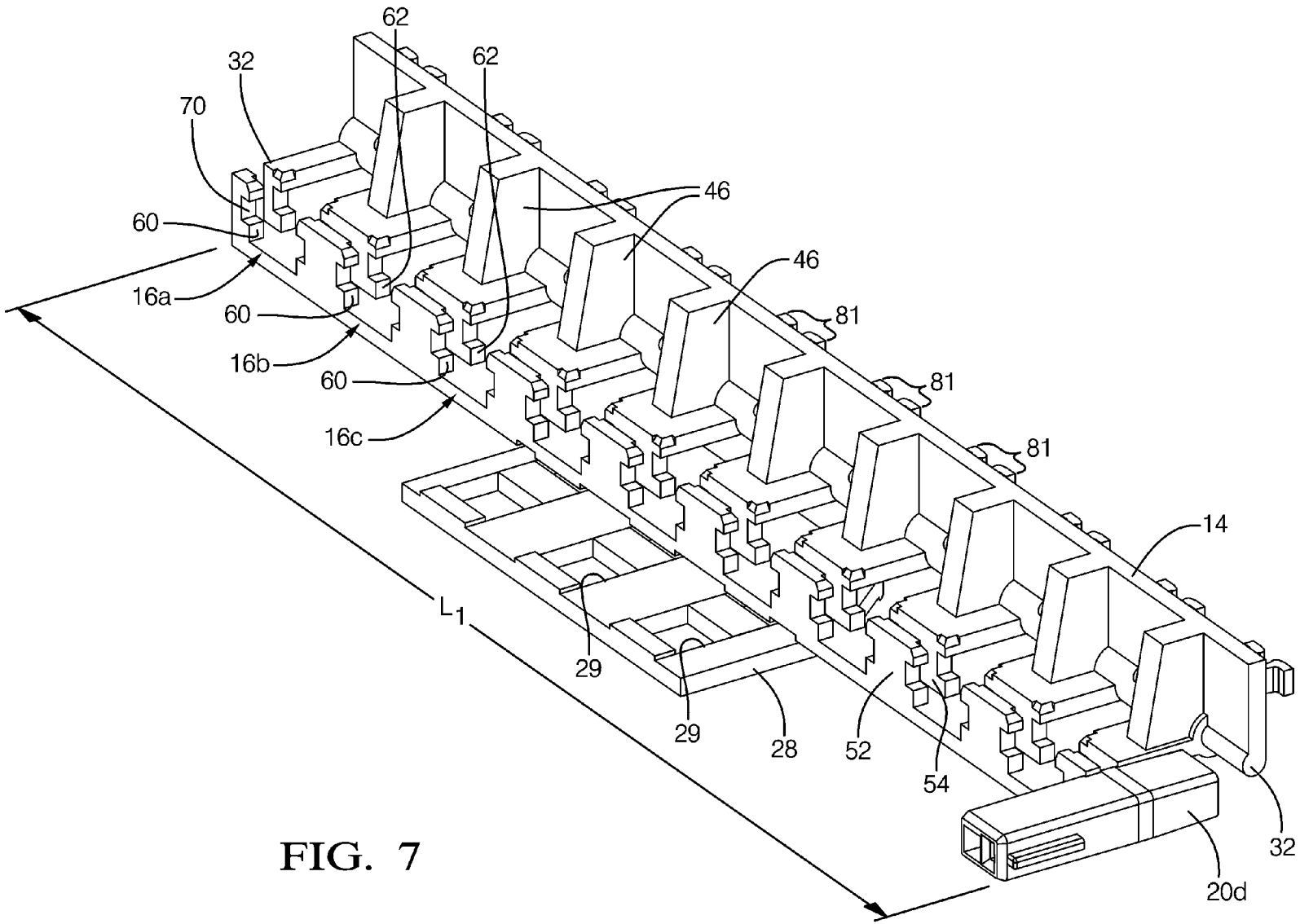
FIG. 7 shows a rear-side, right-hand view of the support frame of the electrical connection system of FIG. 1, with the plurality of first connectors not received in the receptacles.
Figure 8:
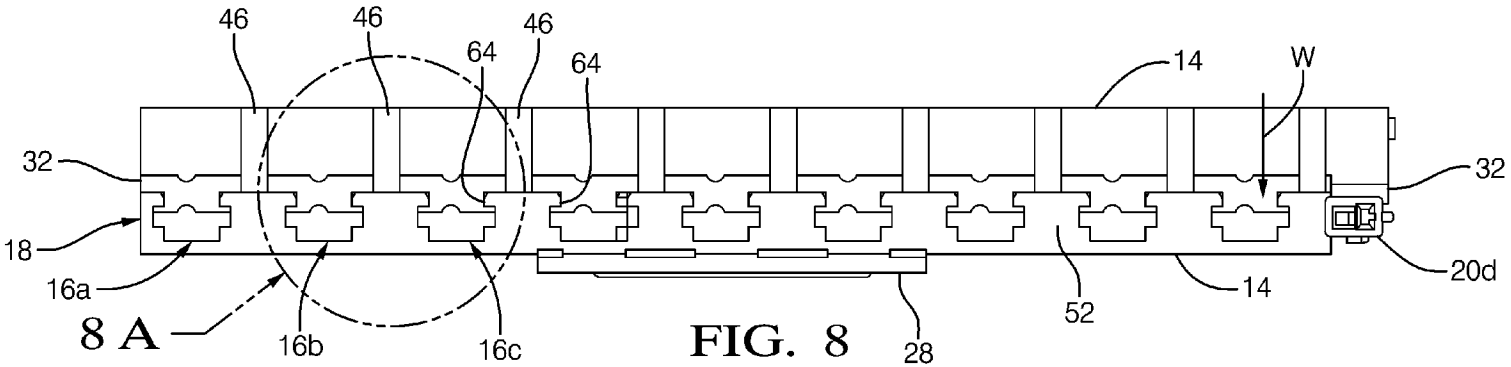
FIG. 8 shows a view looking into the first rail of the arrangement of FIG. 7.

Referring to FIGS. 1-10, a ganged floating electrical connection system 10 is capable to absorb predetermined positional mating tolerance variation. Referring to FIGS. 1 and 7, electrical connection system 10 includes an arrangement 12. Arrangement 12 includes a support frame 14 that defines a plurality of receptacles 16 disposed along a length $L_1$ of support frame 14 generally perpendicular to a mating axis A. Plurality of receptacles 16 are formed in support frame 14 in one or more rows 18. Arrangement 12 is formed when a plurality of first, or female connector housings or bodies, or connectors 20 receivably coupled in a plurality of receptacles 16 in row 18. A plurality of second, or male connector housings or bodies, or connectors 22 are attachable to arrangement 12 being matable to plurality of coupled female connectors 20 along a general mating axis A. For example, referring to FIG. 1, male connector 22*a* mated to the header of coupled female connector 20*a* is defined as a first set of connectors of electrical connection system 10 where electrical connection system 10 has multiple sets of connectors. As illustrated in FIG. 1, connectors 20*b*, 22*b* comprise a second set of connectors, connectors 20*c*, 22*c* comprise a third set of connectors, and connectors 20*d*, 22*d* comprise a fourth set of connectors, and so on to include the total number of sets of connectors disposed in electrical connection system 10. Positional mating tolerance variation for each set of connectors is assimilated by support frame 14. Electrical connection system 10 is a 10-way connector where ten male connectors 22 mate to ten coupled female connectors 20. Alternately, the electrical connection system may include any number of sets of female and male connectors, and support frame may be constructed to include any number of receptacles to receive female connectors. Male connectors 22 are mated to female connectors 20 one connector set at a time. Alternately, male connectors are mated to female connectors more than one at a time. Still yet alternately, male connectors may be associated with a single electrical device and are grouped or banded together in a ganged configuration that generally aligns with the plurality of coupled female connectors and the predetermined positional mating tolerance variation between the individual male and individual coupled female connectors is assimilated by the arrangement when the connectors are mated together. The ganged configuration of individual male connectors may be mated with the ganged configuration of the individual coupled female connectors in a single-movement, self-aligning, uninterrupted smooth mating connection.

Figure 9:
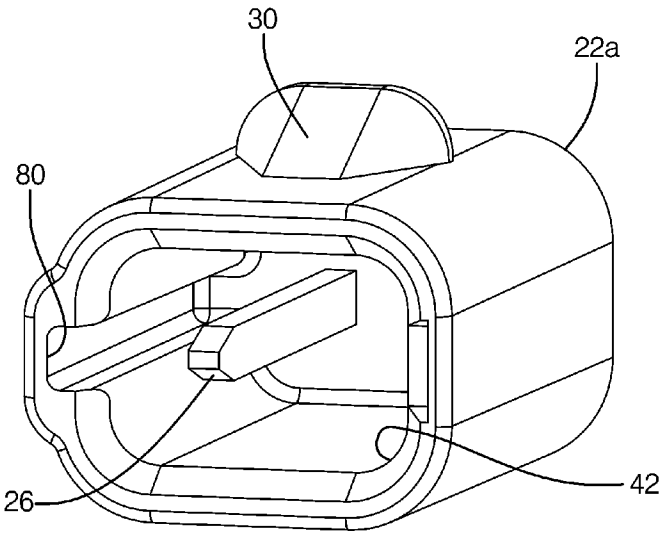
FIG. 9 shows a right-hand view of a second connector of the electrical connection system of FIG. 1, showing details thereof.
Figure 8A:
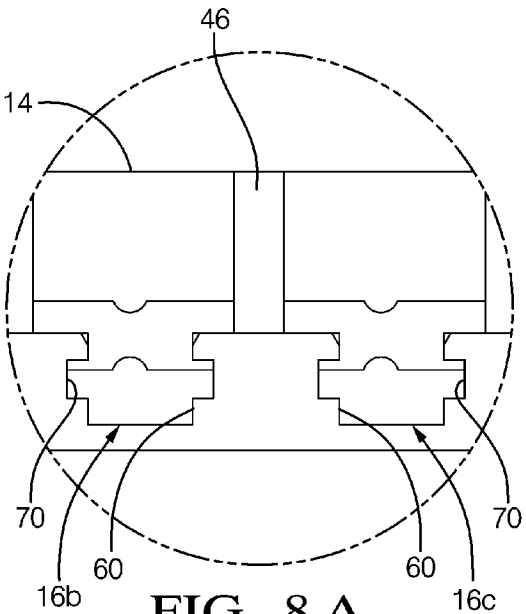
FIG. 8A shows a magnified view of the receptacles of the arrangement of FIG. 8.

Referring to FIGS. 5 and 9, connectors 20, 22 each have one respective electrical contact, or termination. A male mating termination or blade terminal 26 disposed in each male connector 22 mates with a corresponding female mating termination, or terminal (not shown) disposed in each female connector 20. Connector 20 is aptly named as a female connector due to a female terminal being inserted therein. Connector 22 is similarly aptly named as a male connector due to the male terminal inserted therein. This type of connector naming convention is understood by artisans in the wiring arts. Alternately, each male and female connector utilized in the electrical connection system may each include more than one termination. When the electrical connection system has male and female connectors that have more than one termination, a mechanical assist may be needed to mate connectors in these multi-connector, multi-terminated electrical connection systems.

Connectors 20, 22 are formed of a non-electrically conducting dielectric material, such as nylon and polyester and the like. While support frame 14 may be made from any durable material, preferably, support frame 14 is made of a non-electrically conducting material to further ensure that any electrical short that may occur in connectors 20, 22 does not electrically transfer to support frame 14. Preferably, support frame 14 is formed using the dielectric material similar to that used to construct connectors 20, 22 as previously described herein. Using a dielectric material to form support frame 14 is especially desirable when including the integral fixed male connector 12*d* with support frame 14. Support frame 14 and connectors 20, 22 may be formed by injection molding. Alternately, support frame 14 may be formed of a metallic material along with the fixed connector. Still yet alternately, the fixed connector may be fastened to the support frame by any suitable manner, such as welding the fixed connector to the metal support frame. Arrangement 12 further includes an integrated lock arm 28. Lock arm 28 secures incline ramps 30 disposed on male connectors 22 to support frame 14 when female and male connecters 20, 22 are fully mated one-to-another. While lock arm 28 is illustrated in FIG. 1 to communicate with three female connectors 20, lock arm 28 may be constructed to secure any number of connector sets to support frame 14 and is constructed of the same material as that of connectors 20, 22 previously described herein.

For simplification of discussion and not limitation, female connectors 20*a-d*, male connectors 22*a-d*, and receptacles 16*a-c* represent a portion of electrical connection system 10. Female connectors 20*a-c* are receivably coupled in receptacles 16*a-c* in support frame 14. Once receivably coupled in support frame 14, coupled female connectors 20 are sufficiently coupled so as to not easily fall out, or separate from receptacles 16. Female connector 20*d* is a stationary with respect to support frame 14 being fixedly secured to support frame 14. Preferably, female connector 20*d* is integrally molded as part of support frame 14 when support frame 14 is injection molded. Fixed female connector 20*d* is formed at an end 32 of support frame 14 and is used as a locating connector, or feature for support frame 14 and the remaining female connectors 20 including female connectors 20*a-c* to mate with male connectors 22 when connectors 20, 22 are mated. Alternately, the fixed female connector may be disposed anywhere along the length of the support frame. Still yet alternately, the support frame may not include a fixed female connector. Fixed female connector 20*d* is especially useful when mating arrangement 12 with a ganged configuration of male connectors as previously discussed. For this type of ganged mating connection, fixed connector set 20*d*, 22*d* may be initially partially mated so the remaining female and male connectors 20, 22 including connectors 20*a-c*, 22*a-c* generally align in preparation for a final mating of connectors 20, 22 in the single-movement, uninterrupted smooth mating connection, as also previously discussed herein. The final mating of these connectors may occur with a single force applied against either the support frame that includes the plurality of coupled female connectors or the plurality of male connectors towards the opposing coupled female connectors until the connectors are fully mated when incline ramps 30 of the male connectors 22 are inserted in openings 29 of integrated lock arm 28.

Figure 2:
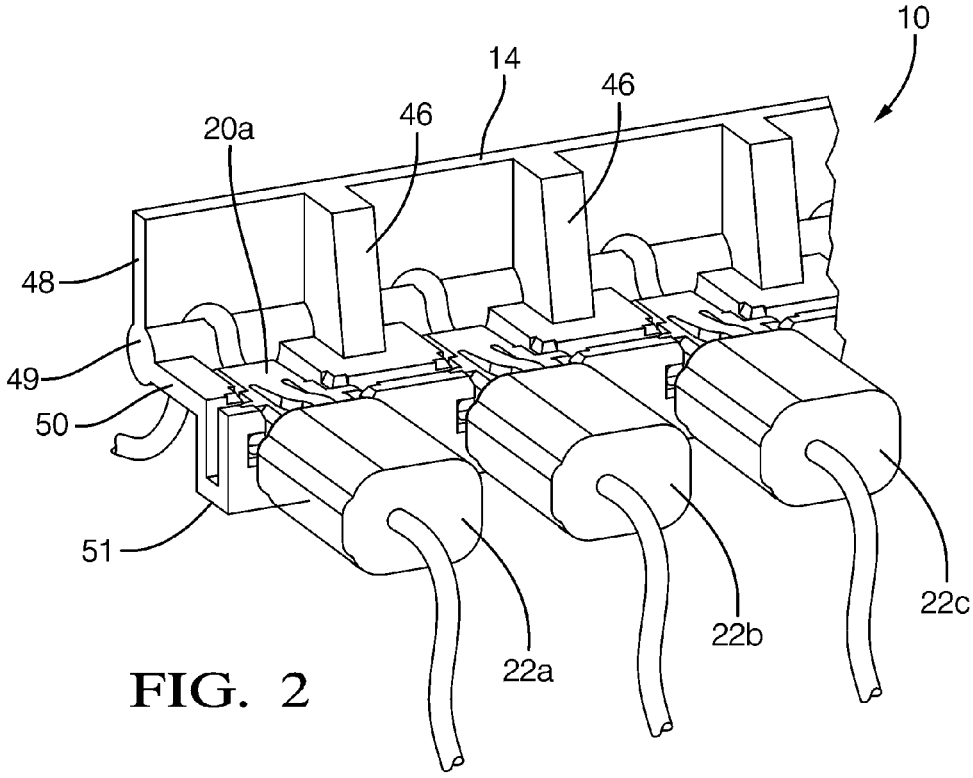
FIG. 2 shows a portion of the electrical connection system of FIG. 1, and details thereof.
Figure 3:
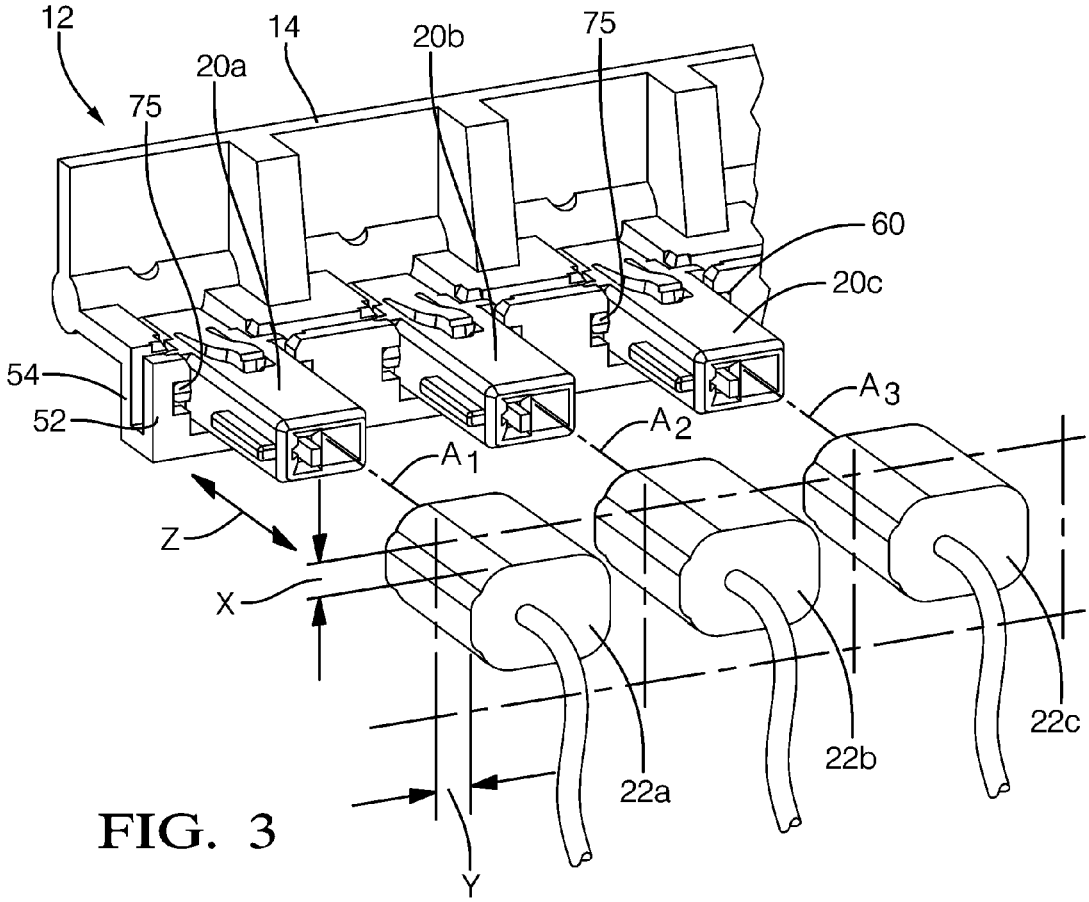
FIG. 3 shows the portion of the electrical connection system of FIG. 2 with the second connectors unmated from the arrangement.

Referring now to FIGS. 2 and 3, individual male connectors 22*a-d* mate to individual female connectors 20*a-d* along mating axis A with male connectors 22*a-c* mating to coupled female connectors 20*a-c* along individual mating axes $A_1$, $A_2$, $A_3$ Mating axes $A_1$, $A_2$, $A_3$ are a subset of general axis A. Electrical connection system 10 provides an electrical interface between wire conductors 36 that are in electrical communication with one or more electrical devices (not shown) in an electrical circuit application of use. Wire conductors 38 that are also in electrical communication with one or more other electrical devices (not shown) in the electrical circuit application of use. Alternately, the wire conductors attached to the male or the female connectors may be attached to one or more printed circuit boards. Still yet alternately, the terminals attached to either of both of the male and the female connectors may be directly attached to one or more printed circuit boards. A combination of tabs and shoulders disposed on the terminal of female connector 20 and terminal 26 of male connector 22 and/or cavities 40*a-b* of female connector 20 and cavity 42 of male connector 22 retains these terminals in cavities 40*a*, 40*b*, 42 and is known in the electrical connection and wiring arts. Cavity 40*b* of female connector 20*a* is hallowed out in a suitable manner that allows a flexible lock (not shown) of the female connector to be constructed properly. The flexible lock is the primary terminal lock to retain the female terminal within cavities 40*a*, 40*c* of female connector 20. Wire conductors 36, 38 may be electrically and mechanically connected to their associated terminals of male and female connectors 20, 22 by any known method, such as crimping, for example. The terminals are made of an electrically conducting material, such as tin or brass. The terminal disposed in female connector 20*a* receives terminal 26 of male connector 22*a* disposed in cavity 42, as best illustrated in FIG. 9, when connectors 20, 22 are mated, as best illustrated in FIG. 3. The remaining male and female connector sets in electrical connection system have similar related features as for connector sets 20*a* and 22*a*, 20*b* and 22*b*, 20*c* and 22*c*, and 20*d* and 22*d* previously discussed herein.

Figure 4:
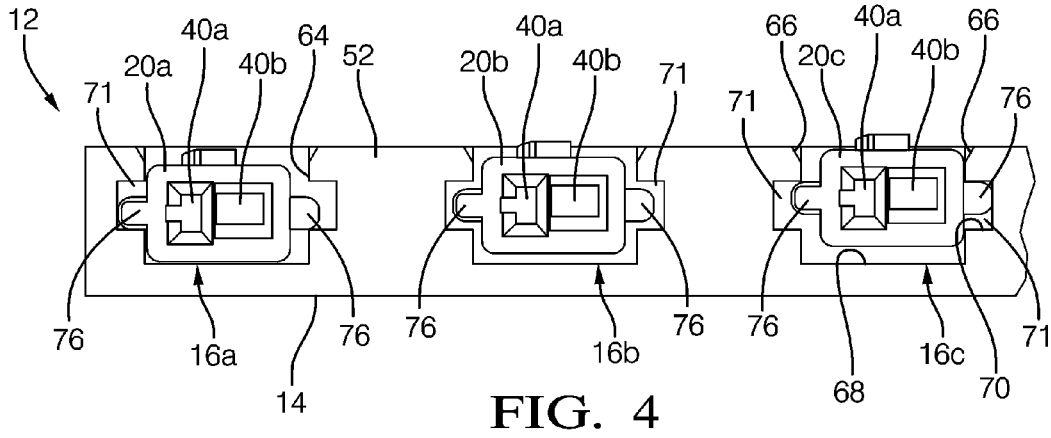
FIG. 4 shows various float positions of the coupled first connectors when the second connectors are mated to the coupled first connectors in the electrical connection system of FIG. 1, looking into the first rail of the support frame.

For even further simplification of the discussion and not limitation, referring to FIGS. 1-9, the details of a single receptacle 16*a* of support frame 14 of electrical connection system 10 will now be described. In contrast to stationary, integral, fixed female connector 20*d*, female connector 20*a* is not rigidly fixed in receptacle 16*a* of frame 14. Rather, female connector 20*a* is receivably coupled in receptacle 16*a* so that female connector 20*a* is allowed to move gently, drift, or have floating movement about mating axis $A_1$ of receptacle 16*a*. Referring to FIG. 3, female connector 20*a* floats in an X-direction or a Y-direction orthogonal to mating axis $A_1$ in response to positional mating tolerance variation manifested at receptacle 16*a* between connectors 20*a*, 22*a* when connectors 20*a*, 22*a* are mated together. The floating movement of female connector 20*a* allowed within receptacle 16*a* ensures receptacle 16*a* to absorb any amount of the predetermined positional mating tolerance variation between connectors 20*a*, 22*a* manifested at, and absorbed by receptacle 16*a*. In similar fashion, different receptacles 16*b-c* may also absorb different amounts of predetermined positional mating tolerance variation as manifested at their individual receptacles 16*b-c*. By way of example and not limitation, referring to FIG. 4, receptacle 16*a* receives an amount of predetermined positional mating tolerance variation manifested at receptacle 16*a* such that female connector 20*a* floats in receptacle 16*a* to have a float position in receptacle 16*a* in a top/right position location of receptacle 16*a*. Receptacle 16*b* receives an amount of predetermined positional mating tolerance variation manifested at receptacle 16*b* so that female connector 20*b* floats within receptacle 16*b* to have a float position in a central position location of receptacle 16*b*. And receptacle 16*c* experiences an amount of predetermined positional mating tolerance variation that floatingly positions female connector 20*c* at a bottom/left location of receptacle 16*c*. In contrast, if a different amount of predetermined positional mating tolerance variation is manifested at receptacle 16*a* from that illustrated in FIG. 4, female connector 20*a* may be similarly floatingly positioned in a central position location or a bottom/left position location similar to that as shown with receptacles 16*b*, 16*c* as illustrated in FIG. 4. Thus, the placement of female connectors 20 due to float movement in receptacles 16 depends on the amount of predetermined positional mating tolerance variation of female connectors 20 relative to male connectors 22 that needs to be absorbed by arrangement 12 when connectors 20, 22 are mated along mating axis A. As female connector 20*d* is fixedly attached to support frame 14 and provides positional alignment for the mating of the remaining connectors sets 20, 22, female connector 20*d* does not need to absorb predetermined positional mating tolerance when connectors 20, 22 are mated.

Referring to FIGS. 1-2, support frame 14 has a generally right angle-type shape. This right angle-type shape includes buttresses 46 disposed along length $L_1$ between each receptacle 16 to provide strength for support frame 14 and further support coupled female connectors 20 and male connectors 22 mated to coupled female connectors 20. Referring to FIG. 2, support frame 14 includes a first 48, a second 49, a third 50, and a fourth portion 51. First portion 48 and third portion 50 are generally planer. Rounded shoulder or second portion 49 is generally circular. Second portion 49 is connected to first and third portion 48, 50 while being disposed intermediate first and third portion 48, 50 such that third portion 50 is generally perpendicular to first portion 48 with second portion 49 effectively being an origin point. Fourth portion 51 is generally U-shaped in cross-section being connected to third portion 50. Fourth portion 51 is disposed remote from rounded shoulder portion 49. Portions 48, 49, 50, 51 are formed as a single unitary piece such that a first bar, or rail 52 and a second bar, or rail 54 are formed integral with support frame 14. Buttresses 46 are also formed integral to support frame 14. Rails 52, 54 and buttresses 46 are molded when support frame 14 is injection molded. Constructing support frame 14 from a non-metal material enhance the bending flexibility of support frame 14, which is especially useful when the female connectors 20 are received in the support frame 14.

Fourth portion 51 of support frame 14 defines plurality of receptacles 16. Female connector 20*d* is fixedly attached to fourth portion 51. Referring to FIG. 6, fourth portion 51 includes rails 52, 54 that extend and depend away from a floor 56 of support frame 14. First rail 52 has a generally parallel, spaced relationship with second rail 54 along floor 56 of support frame 14. This parallel, spaced relationship of rails 52, 54 further defines a slotted space, channel, or slot 58 between first and second rail 52, 54. Rails 52, 54 are generally disposed on support frame 14 perpendicular to axis A when male connectors 22 are mated to coupled female connectors 20 along axis A. Fourth portion 51 is attached to third portion 50 at second rail 54 along length $L_1$. Again referring to FIG. 2, second rail 54 attaches to third portion 50 so that an inside portion of the U-shape of fourth portion 51 faces a direction parallel to a direction of first portion 48 as first portion 48 depends away from rounded shoulder portion 49. Support frame 14, as shown in FIG. 7, is disposed in its normal position. When support frame 14 is in its normal position, support frame 14 is not being curvingly bent, or flexed.

Typically, buildings have doors that may contain mechanical locks. These locks may include keyholes with a mechanical door key being inserted into the keyhole to unlock the door and gain access to the building. Electrical connection system 10 also includes keyholes 60, 62. Referring to FIGS. 3, 4, 6-8, and 8A, first rail 52 defines a keyhole 60 associated with each receptacle 16*a-c*. Second rail 54 defines a keyhole 62 associated with each receptacle 16*a-c*. Keyholes 60, 62 are substantially axially aligned in receptacles 16*a-c* when defined in support frame 14. Turning our attention now to a single keyhole, keyhole 60 in receptacle 16*a* of first rail has an open end 64. Open end 64 includes chamfered edges 66 that transition into a main portion 68 of keyhole 60. Chamfered edges 66 are useful to guide female connector 20*a* into main portion 68 of keyhole 60 when female connector 20*a* is received into receptacle 16*a*. Keyhole 60 further includes a pair of opposing, laterally spaced recesses 70 where each recess 70 has a defined area 71. Keyhole 60, recesses 70, and area 71 encompassed by recesses 70 are disposed on support frame 14 being perpendicular to mating axis A. First rail 52 is in communication with floor 56 of support frame 14 along length $L_1$ except where first rail 35 defines keyholes 60, as best shown in FIGS. 6-7. The remaining keyholes 60, 62 in the remaining receptacles 16 of support frame 14 have similar structure and construction of open ends, chamfered edges, and recesses as key hole 60 of receptacle 16*a*, as previously described herein. Similar to the mechanical door key, female connectors 20 are insertable and receivably coupled in receptacles 16 through open ends 64 of keyholes 60, 62. In contrast to the typical mechanical door key, female connectors 20 are received in receptacles 16 through open ends 64 in a direction w perpendicular to mating axis A.

Receptacles 16*a-c* have a centerline-to-centerline spacing of a distance d from each other along length $L_1$ on rails 52, 54 and fixed female connector 20*d* has a centerline-to-centerline spacing from an adjacent receptacle that is different from distance d. The values of distance d dependent on the application of use for the electrical connection system and the predicted positional mating tolerance associated with the individual connector sets. Alternately, the plurality of receptacles may have any desired centerline-to-centerline spacing one-to-another along the length of support frame. For example, in one embodiment, some receptacles may be spaced one-to-another a distance d, while others may be spaced one-to-another a distance different from distance d along the length of the support frame. The positional distance of the fixed female connector from an adjacent receptacle may also be dependent on the centerline-to-centerline spacing of a corresponding male connector at the end of the support frame of the electrical connection assembly. In still other embodiments, the distance d between each receptacle along the length of the support frame may have a value different from the value of distance d. In still yet other embodiments, the fixed female connector may have a centerline-to-centerline spacing of distance d from an adjacent connector.

While support frame 14 has a generally rigid structure, support frame 14 is sufficiently resilient to allow a small amount of bending, or flexure of support frame 14 about mating axis A when a force is applied simultaneously at each end 32 of support frame 14. When a force is applied to each end 32, support frame 14 flexingly bows in a small concave arc, or shape sufficiently enough to allow open ends 64 of receptacles 16 to open wide enough so that female connectors 20 are insertable, or snap-fitted in respective keyholes 60, 62 of receptacles 16 to form arrangement 12. The applied forces at ends 32 may be supplied by using the human hands of a human operator or by an automated machine by methods known in the wire connection arts. When these applied forces are removed from ends 32, support frame 14 returns to its normal position, as best illustrated in FIG. 7. In the normal position, open ends 64 return to about their original size so that female connectors 20 receivably coupled in receptacles 16. When female connectors 20 are receivably coupled in receptacles 16, female connectors 20 are not only retained in receptacles 16, but also experience float movement of female connector 20 about mating axis A in an X-direction or a Y-direction with respect to mating axis A orthogonal to mating axis A in receptacle 16. Thus, the size of receptacle 16*a* is large enough to receive, secure and allow floating movement of female connector 20*a* in receptacle 16*a*, but not so large that female connector 20*a* is easily removed from receptacle 16*a* once support frame 14 is disposed in its normal position. Thus, the floating movement of female connectors 20 in receptacles 16 assimilates any amount of predetermined positional mating tolerance variation of male connector 22 in relation to coupled female connector 20 when connectors 20, 22 are mated.

Referring to FIG. 5, female connector 20*a* has a length $L_2$ and a generally rectangular cross-sectional shape along length $L_2$. Female connector 20*a* includes a forward section 72 and a rearward section 73. Forward section 72 generally has a smaller rectangular cross sectional shape then rearward section 73 and forward section 72 generally contributes a smaller amount of length to length $L_2$ that does that of rearward section 73. Alternately, the forward and rearward sections may have other different lengths to comprise length $L_2$. Forward section 72 is generally laterally offset from rearward section 73 in a direction perpendicular to axis A when female connector 20*a* is received into receptacle 16*a*. This offset allows for female connector 20*a* to be inserted and received in receptacle 16*a* in a single orientation for ease of assembly of arrangement 12.

A locating flange 74 divides, and provides an interface between forward and rearward sections 72, 73. Flange 74 includes a pair of laterally-disposed forward lock ears 75 adjacent flange 74 that face towards forward section 72. Flange 74 includes another pair of laterally-disposed rearward lock ears 76 adjacent flange 74 that face towards rearward section 73. Forward section 72 is received in receptacle 16*a* and rearward section 73 receives cavity 42 of male connector 22*a* when connectors 20*a*, 22*a* are mated. Flange 74 and forward section 72 communicate with support frame 14 when forward section 72 is received into receptacle 16 where locating flange 74 is positioned to fit in slot 58. When forward section 72 of female connector 20*a* is inserted into keyholes 60, 62 of receptacle 16*a*, at least a portion of forward lock ears 75 communicate within areas 71 of recesses 70 of keyhole 60 and at least a portion of rearward lock ears 76 communicate within areas 71 of recesses 70 of keyhole 62. For instance, lock ear 76 communication with recesses 70 is best illustrated in FIG. 4. Areas 71 of recesses 70 of keyholes 60, 62 bound the movement of female connector 20*a* within keyholes 60, 62 in receptacle 16*a*. Thus, the positional mating tolerance variation for receptacle 16*a* is directly related to area 71 of recesses 70 of keyholes 60, 62 and the size of lock ears 75, 76 that move within areas 71 of each recess 70 in keyholes 60, 62. For example, in one embodiment, the size of the lock ears is larger than as shown in FIG. 4, thus further restricting float movement of the female connector in the receptacle. Preferably, area 71 of recesses for all keyholes 60, 62 is identical and the size of lock ears 75, 76 is also identical. Alternately, the areas and size of lock ears may not all be identical depending on the positional mating tolerance variation that needs to be absorbed in the receptacles of the support frame and is dependent on the application where the electrical connection system is employed. Regardless of the float position of female connectors 20*a-c* in receptacles 16*a-c* as illustrated in FIG. 4, at least a portion of respective lock ears 75, 76 are disposed within area 71 of respective recesses 70.

Primary terminal lock and secondary terminal lock 34 are disposed in female connector 20 ensure the female terminal disposed in cavities 40*a*, 40*b* is locked in female connectors 20. Secondary terminal lock 34 spans forward and rearward sections 72, 73. Preferably, secondary terminal lock 34 is an integrated secondary lock (ISL). The primary and secondary terminal locks are known to artisans in the connector arts. Rearward section 73 further includes an index rib 77, a blade lead-in portion 78 and a connector lead-in portion 79. Lead-in portions 78, 79 on female connector 20*a* provide further assistance to guide terminal 26 of male connector 22*a* and male connector 22*a* to positively mate with the female terminal of female connector 20*a*. An index groove 80 disposed on male connector 22*a* ensures correct mating orientation of male connector 22*a* to female connector 20*a* when connectors 20*a*, 22*a* are mated. If index groove 80 and lead in portions 78, 79 do not align during mating of connectors 20*a*, 22*a*, connectors 20*a*, 22*a* will not mate. Alternately, the female connector may be any shape where the keyhole has a larger corresponding shape where the female connector is adequately receivably coupled in the keyholes.

When flange 74 is fitted in slot 58 as female connector 20*a* is received in receptacle 16*a*, flange 74, slot 58, and first and second rail 52, 54 collectively cooperate to prevent float movement of female connector 20*a* in a Z-axis direction in relation to receptacle 16*a*. Slot 58 has sufficient width to fit flange 74, but not so large so as to allow float movement of female connector 20*a* in the Z-axis direction in relation to receptacle 16*a*. The Z-axis direction is co-axial with mating axis A. Rails 52, 54 provide a stiff support for fitted flange 74 to keep flange 74 from moving in the Z-axis direction. Additionally, flange 74 fits into slot 58 in a single mating orientation. If flange 74 is fitted in slot 58 in a different orientation, for example being 180 degrees out-of-phase with the correct orientation, forward section 72 is orientated incorrectly with respect to receptacle 16*a*. Incorrect orientation results in forward section 72 interfering with structure of support frame 14 surrounding receptacle 16*a* such that female connector 20*a* is not received in receptacle 16*a*. Index groove 80 on male connector 22*a* receives index rib 77 of female connector 20*a* when connectors 20*a*, 22*a* are mated. Male connector 22*d* that mates with fixed female connector 20*d* may not have an index rib.

Other female connectors 20, male connectors 22, and receptacles 16 are respectively constructed and operate in support frame 14 in a similar manner and have similar functional relationships to absorb predetermined positional mating tolerance variation as female connector 20*a*, male connector 22*a*, and receptacle 16*a* previously described herein.

Before use in an electrical circuit application, arrangement 12 is constructed. Female connectors 20 are receivably coupled in receptacles 16 of support frame 14, as previously discussed herein. The laterally offsetting forward and rearward sections 72, 73 of female connectors 20 provide for a keyed insertion of female connectors 20 in receptacles 16*a-c* of support frame 14 in a certain, single orientation, as also previously discussed herein. The ISL secondary terminal lock 60 is set to a pre-staged condition before being shipped to a location where electrical connection system 10 is employed. After female terminal connected to wire conductor 36 is inserted in cavities 24*a*, 24*b*, terminal lock 60 is put in a final lock position to further secure the female terminal in female connectors 20. Arrangement 12 is preferably constructed at a manufacturing site apart from where electrical connection system 10 is employed for its intended use in an electrical circuit application. Arrangement 12 is now ready for use in an electrical circuit application.

When electrical connection system 10 is not in use, voltage or current is not electrically transmitted through arrangement 12 of electrical connection system 10. This condition may occur when either arrangement 12 is not disposed in the electrical circuit application. This condition may also occur when male connectors 22 are not mated to coupled female connectors 20, and/or terminals of wire conductors 36, 38 are not received in coupled female connectors 20 in arrangement 12. FIGS. 3 and 7 illustrate examples of arrangement 12 being not in use. In FIG. 3, male connectors 22 are not yet mated to coupled female connectors 20. In FIG. 7, the female connectors 20 have not yet been receivably coupled to support frame 14.

Figure 10:
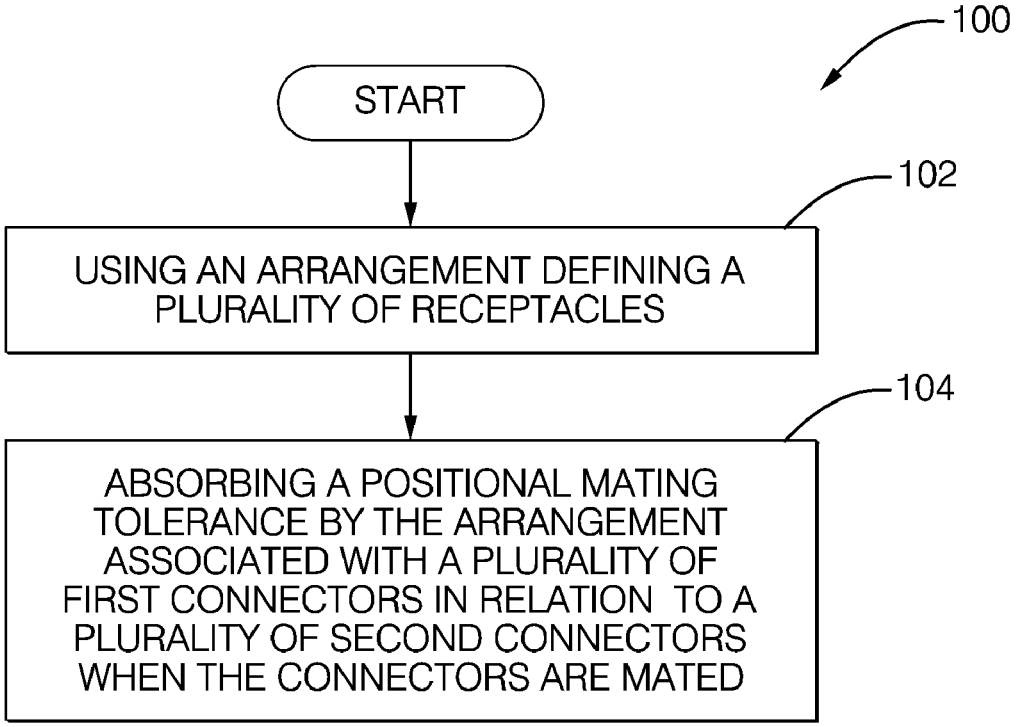
FIG. 10 shows a method for absorbing positional mating tolerance by the arrangement in the electrical connection system of FIG. 1.

Referring to FIG. 1, when electrical connection system 10 is used in an electrical application, arrangement 12 needs further fabrication in to the intended electrical circuit application. Terminals 26 are connected to wire conductors 38 that are part of the electrical circuit application. Terminals connected to wire conductors 36 that are also part of the electrical circuit application are inserted into cavity 24*c* at forward section 72 of coupled female connectors 20 in support frame 14. Wire conductors 26 are further dressed in clips 81 in support frame 14 being maintained on a centerline of connector cavity 40*c* in grooves notched in rounded shoulder 49. If needed, fixed female connector 20*d* may connect with a corresponding locating male connector 22*d* so as to align arrangement 12 with remaining male connectors 22 in the electrical circuit application especially when arrangement 12 is connected to a single electrical device having multiple connectors. Primary flexible terminal lock and secondary terminal lock 34 retain female terminal in female connector 20 where secondary terminal lock 34 is set to a final stage position. Referring to FIG. 10, using arrangement 12 and female and male connectors 20, 22 in the electrical connection system 10 is step 102 in method 100. Because female connector 20 floats in receptacles 16 in arrangement 12, a gang of male connectors 22 associated with a single electrical device may be mated with coupled female connectors 20 with application of a single uninterrupted force applied against one of the plurality of connectors 20, 22 toward the other one of the connectors 20, 22 in a single movement, as previously discussed herein. As male connectors 22 mate with female connectors 20, the predetermined positional mating tolerance variation of male connectors 22 in relation to female connectors 20 is absorbed by support frame 14 as manifested at each receptacle 16 in the X- and Y-axis direction about each receptacle 16. Absorbing the positional mating tolerance variation in arrangement 12 is step 104 in method 100. Thus, electrical connection system 10 provides a robust, easy to use electrical interface between electrical devices in the electrical circuit application.

Figure 12:
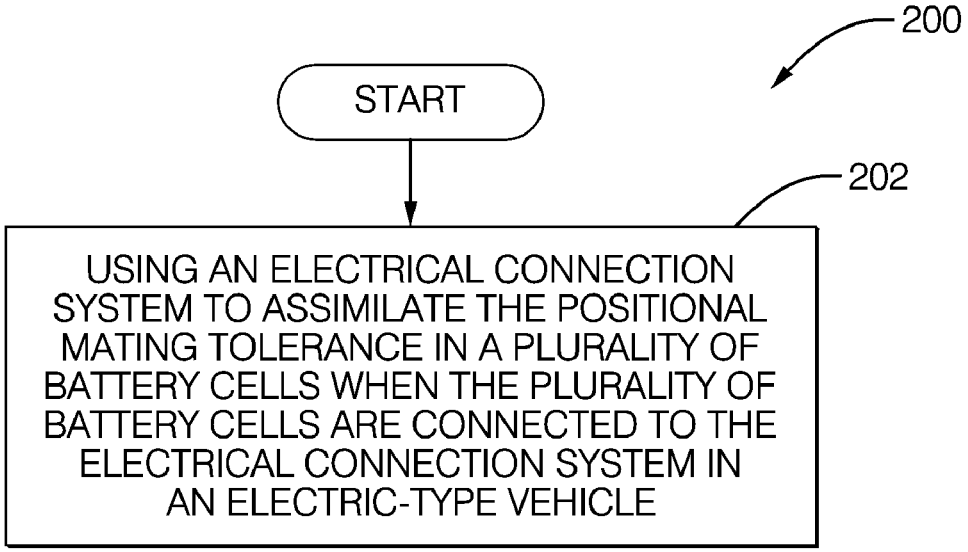
FIG. 12 shows a method for using the electrical connection system of FIG. 11 that assimilates the positional mating tolerance of the plurality of battery cells when the plurality of battery cells are connected to the electrical connection system of FIG. 11.
Figure 11:
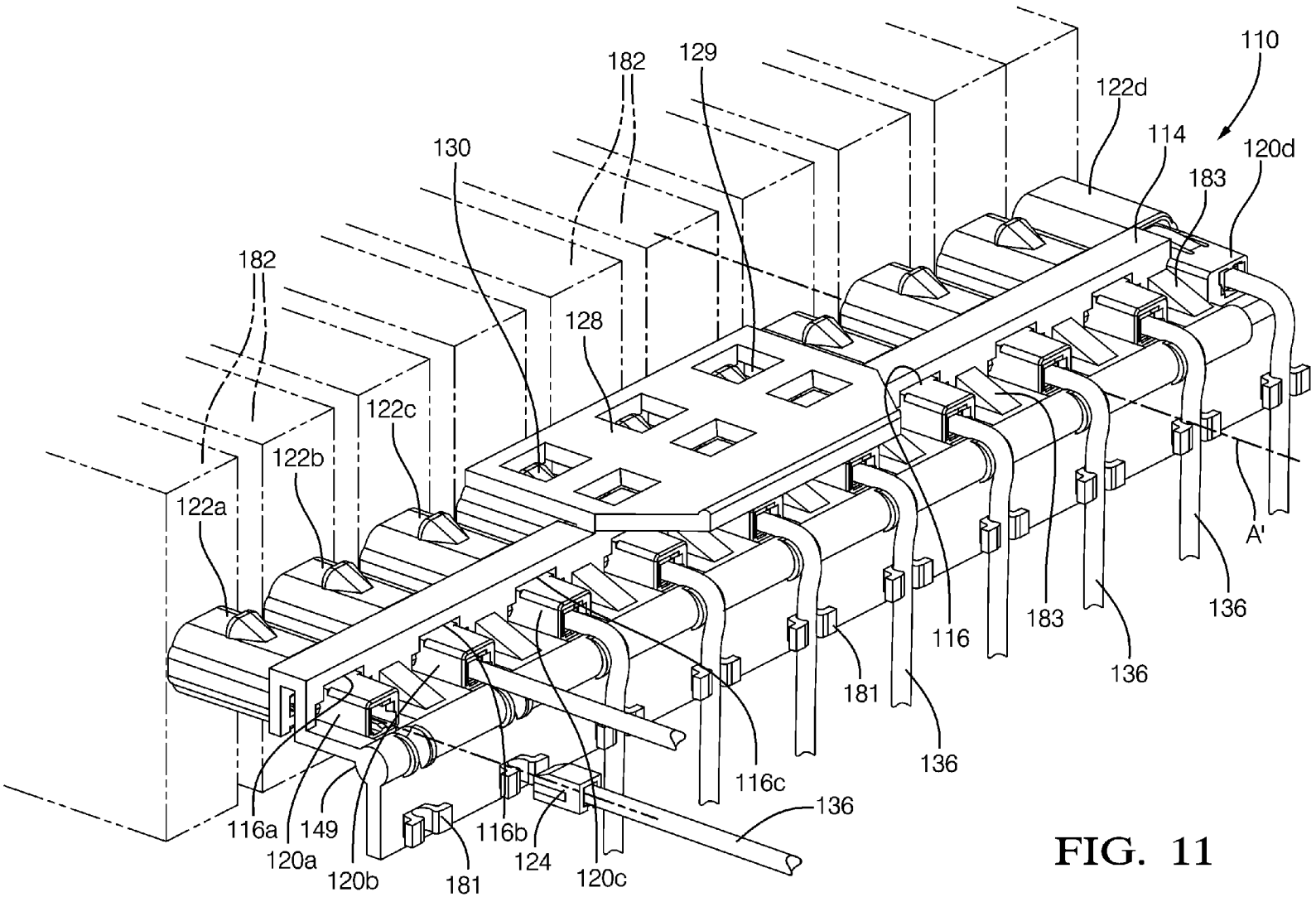
FIG. 11 shows a plurality of battery cells in a battery stack connected to an electrical connection system according to an alternate embodiment of the invention.

Now, turning our attention to an alternate embodiment, referring to FIGS. 11 and 12, electrical connection system 110 is employed in an electrical circuit application in an electric-type vehicle. Elements in the alternate embodiment of FIGS. 11 and 12 that are similar to the elements of the embodiment of FIGS. 1-10 have reference numbers that differ by 100. The electric-type vehicle (not shown) may include an electric-only motor or an electric motor that operates in combination with a conventional hydrocarbon fuel motor to power the vehicle down a road. Electrical connection system 110 electrically connects a battery stack including a plurality of battery cells 182 to an electrical device (not shown) disposed in the electric-type vehicle. In one embodiment, the electrical device is a controller (not shown) where the controller performs battery electrical charge analysis on battery cells 182. Alternately, the electrical connection system may used to connect the battery cells to another electrical load (not shown) in the electric or hybrid electric vehicle. Male connectors 122 may be connected to battery cells 182 so that each battery cell 182 is connected with a specific male connector 122. Battery cells 182 may have an alignment to each other similar to that of a stack of plastic cassette disk (CD) cases placed side-by-side. The side-by-side placement or positioning of battery cells 182 may have a predetermined battery cell-to-battery cell predetermined positional mating tolerance variation in relation to female connectors 120. Male connectors 122 are attached to individual battery cells 182 so that the connected male connectors 122 have an alignment laterally across battery cells 182 that is generally in alignment with coupled female connectors 120. The connected male connectors 122, then, will reflect the predetermined positional mating tolerance variation of battery cells 182 when connectors 120, 122 are mated. The predetermined positional mating tolerance variation between individual battery cells 182 of the battery stack are absorbed and assimilated by individual receptacles 116 in support frame 114 as female and male connectors 120, 122 are mated in a single, uninterrupted smooth connection. Referring to FIG. 12, this assimilation is step 202 in method 200. As the battery stack is generally stationary and fixedly secure in the electric-type vehicle, the smooth connection may be facilitated by a force applied against support frame 114 towards male connectors 122 until connectors 120, 122 are mated. As illustrated in FIG. 11, electrical connection system 110 also includes an integrated lock arm 128, routing clips 181, terminals 124 and wire conductors 136. Terminal 124 attached to wire conductor 136 and female terminal 124 is inserted in female connector 120*a*. Similar female terminals as female terminals 124 would be attached to wire conductors 36 and inserted in female connector 20*a* in the embodiment of FIGS. 1-10. Wire conductors 136 are attached to clips 181 in a similar fashion as that shown in the embodiment of FIGS. 1-10. Clips 81, 181 combine with second portion 49, 149 to provide respective routing clarity and strain relief for wire conductors 36, 136 in the respective electrical connection systems 10, 110. Incline ramps 130 of male connectors 122 are received in openings 129 of integrated lock arm 128 similar to the embodiment of FIGS. 1-10.

In yet another non-limiting alternate embodiment, referring to FIGS. 13-22, an electrical connection system 210 includes an arrangement 212, a plurality of female connectors 220, and a plurality of male connectors 222. Arrangement 212 includes a support frame 214 and female connectors 220*a-c* are receivably coupled in receptacles 216*a-c*. Female connectors 220*a-c* are retained in receptacles by a flexible connector lock 213. Wire conductors 236 are respectively attached to female connectors 220. Male connectors 222 mate to coupled female connectors 220 of support frame 214 along a mating axis A". Wire conductors 238 are respectively attached to male connectors 222. In contrast to arrangements 12, 112 in the embodiments as shown in FIGS. 1-12, arrangement 212 allows coupled female connectors 220*a-c* to floatingly move in an X-axis and a Y-axis and a Z-axis direction within receptacles 216. Similar elements in the alternate embodiment as shown in FIGS. 13-22 to those of the embodiment illustrated in FIG. 1-10 have reference numerals that differ by 200.

Figure 13:
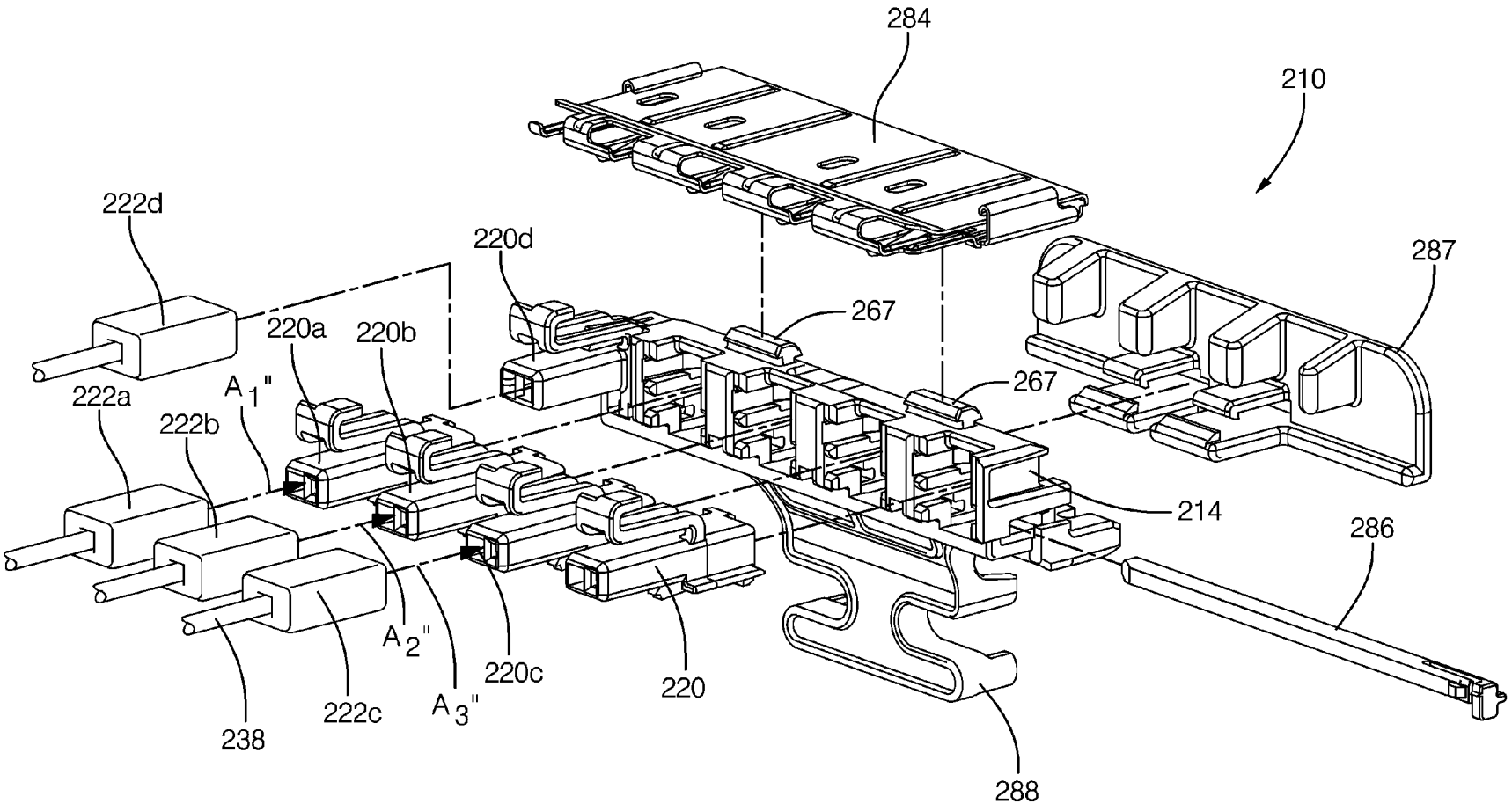
FIG. 13 shows an exploded view of an electrical connection system according to another alternate embodiment of the invention.
Figure 14:
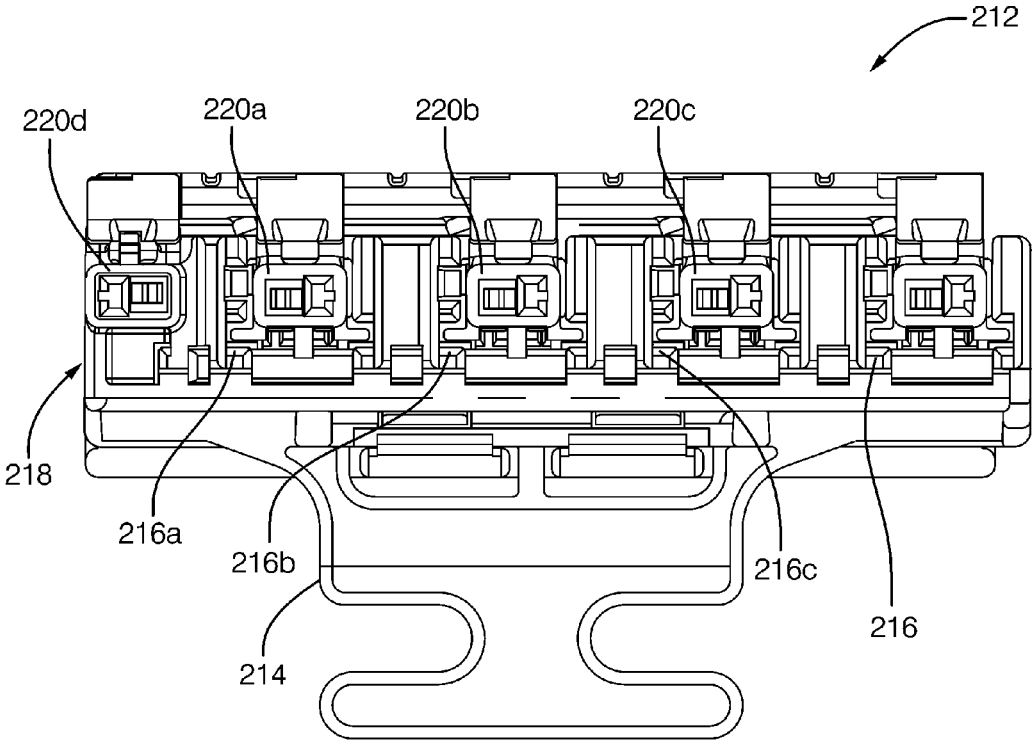
FIG. 14 shows a rear-side, frontal view of an arrangement of the electrical connection system of FIG. 13, and details thereof.

Referring to FIG. 13, arrangement 212 further includes a connector position assurance (CPA) lock 284, a spring 285, a retainer pin 286, a wire conductor retainer 287, and a retention tail 288. Support frame 214 is formed, and is constructed of similar material as support frame 14 as described in the embodiments of FIGS. 1-10. Female connector 220*d* is fixedly attached to support frame 214 and preferably integrally molded to support frame 214 similar to the embodiments of FIGS. 1-10. CPA member 284 includes a groove (not shown) that is fitted to one or more rails 267 disposed on support frame 214 so CPA member 284 is movingly attached to support frame 214. CPA member 284 is disposed on support frame 214 adjacent receptacles 216 that are formed in support frame 214 in a row 218. CPA member 284 communicates with mated connectors 220, 222 to be positioned on support frame 214 and ensure mated connectors 220, 222 do not prematurely unmate. For example, a premature unmating may occur if an undesired force is applied along the mating axis that may accidentally unmate at least one of the plurality of second connectors from at least one of the plurality of first connectors when it is desired that unmating not occur. A premature unmating of the connectors in the electrical connection system may cause the electrical devices connected to the electrical connection system to become undesirably inoperative. CPA member 284 may be constructed of a metal material or a dielectric material similar to that of support frame 14 in the embodiment of FIGS. 1-10. One such CPA member that prevents the female and the male connectors from prematurely unmating is described in non-provisional application U.S. Ser. No. 13/113,301 entitled "BI-DIRECTIONAL CPA MEMBER TO PREVENT UNMATING OF MULTIPLE CONNECTORS," and is incorporated by reference herein. A spring 285 is disposed in each receptacle 216 to absorb Z-axis positional mating tolerance variation when connectors 220, 222 are mated together. Preferably, spring 285 is a resilient spring. One such resilient spring is described in non-provisional application U.S. Ser. No. 13/113,313 entitled "ELECTRICAL CONNECTION SYSTEM HAVING DIELECTRIC SPRING TO ABSORB AXIAL POSITIONAL MATING TOLERANCE VARIATION FOR MULTIPLE CONNECTORS," and is incorporated by reference herein. Coupled female connectors 220*a-c* are additionally attached and secured to support frame 214 using retainer pin 286. Wire conductor retainer 287 further secures wire conductors 236 that communicate with female connectors 220 while also assisting to limit undesired rocking movement motion of support frame 214 when electrical connection system 210 is assembled together in an electrical application. Rocking motion of the electrical connection system during assembly in the electrical circuit application may cause undesired damage to the electrical connection system. Terminal 224 is electrically connected to wire conductor 236 similar to the embodiment as shown in FIG. 11.

Connectors 220, 222 are fully, or completely mated together when the terminals of the connectors 220, 222 are mated together so that terminal electrical connections are realized within electrical connection system 210. Additionally, connectors 220, 222 are fully engaged respective ramps (not shown) of male connectors 222 are engaged with lock arms 203 of coupled female connectors 220. The ramps are similar to ramps 30 of the embodiment of FIGS. 1-10. Connectors 220, 222 are also fully mated when CPA member 284 is able to be positioned on support frame 214 in a manner to ensure fully mated connectors 220, 222 do not unmate.

When receivably coupled in support frame 214, female connectors 220 including female connectors 220*a-c* movingly float about each receptacle in plurality of receptacles 216*a-c* in an X-axis, a Y-axis, and Z-axis direction in relation to each receptacle. Plurality of male connectors 222 mate to plurality of female connectors 220 along mating axis A". Mating axis A" includes mating axes $A_1$", $A_2$", $A_3$" and male connectors 222*a-c* mate with coupled female connectors 220*a-c* along mating axes $A_1$", $A_2$", $A_3$". Plurality of receptacles 216*a-c* absorb predetermined positional mating tolerance variation of male connectors 222*a-c* in relation to coupled female connectors 220*a-c* in an X-axis, Y-axis, and Z-axis direction about each receptacle in relation to each receptacle in plurality of receptacles 216*a-c*. The X-axis and Y-axis direction are orthogonal to each respective mating axes $A_1$", $A_2$", $A_3$" for each receptacle in plurality of receptacles 216*a-c* similar to the embodiment as shown in FIGS. 1-10. The Z-axis direction for each receptacle in plurality of receptacles 216*a-c* is co-axial with each mating axes $A_1$", $A_2$", $A_3$". Spring 285 is attached to support frame 214 and communicates with each receptacle 216 to absorb any amount of predetermined positional mating tolerance variation in the Z-axis direction manifested at each receptacle 216*a-c* when connectors 220, 222 are mated. Retention tail 288 is provides an additional wire routing mechanism for routing of wire conductors 236 when arrangement 212 is employed an electrical circuit application. Retention tail 288 also provides an aid for a human assembler or service technician to handle support frame 214 during assembly of arrangement 212 in an electrical circuit application.

Figure 17:
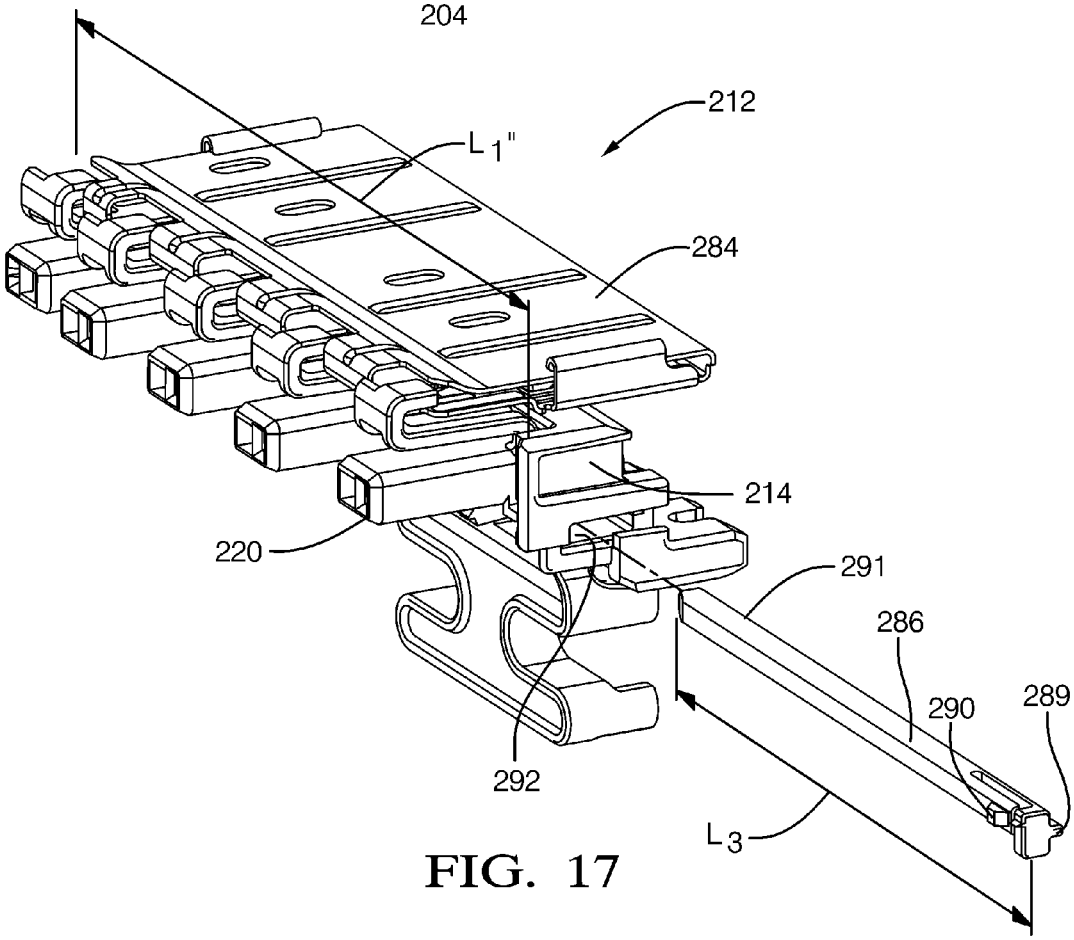
FIG. 17 shows the arrangement of FIG. 14 with a retainer being inserted into a support frame of the arrangement.
Figure 18:
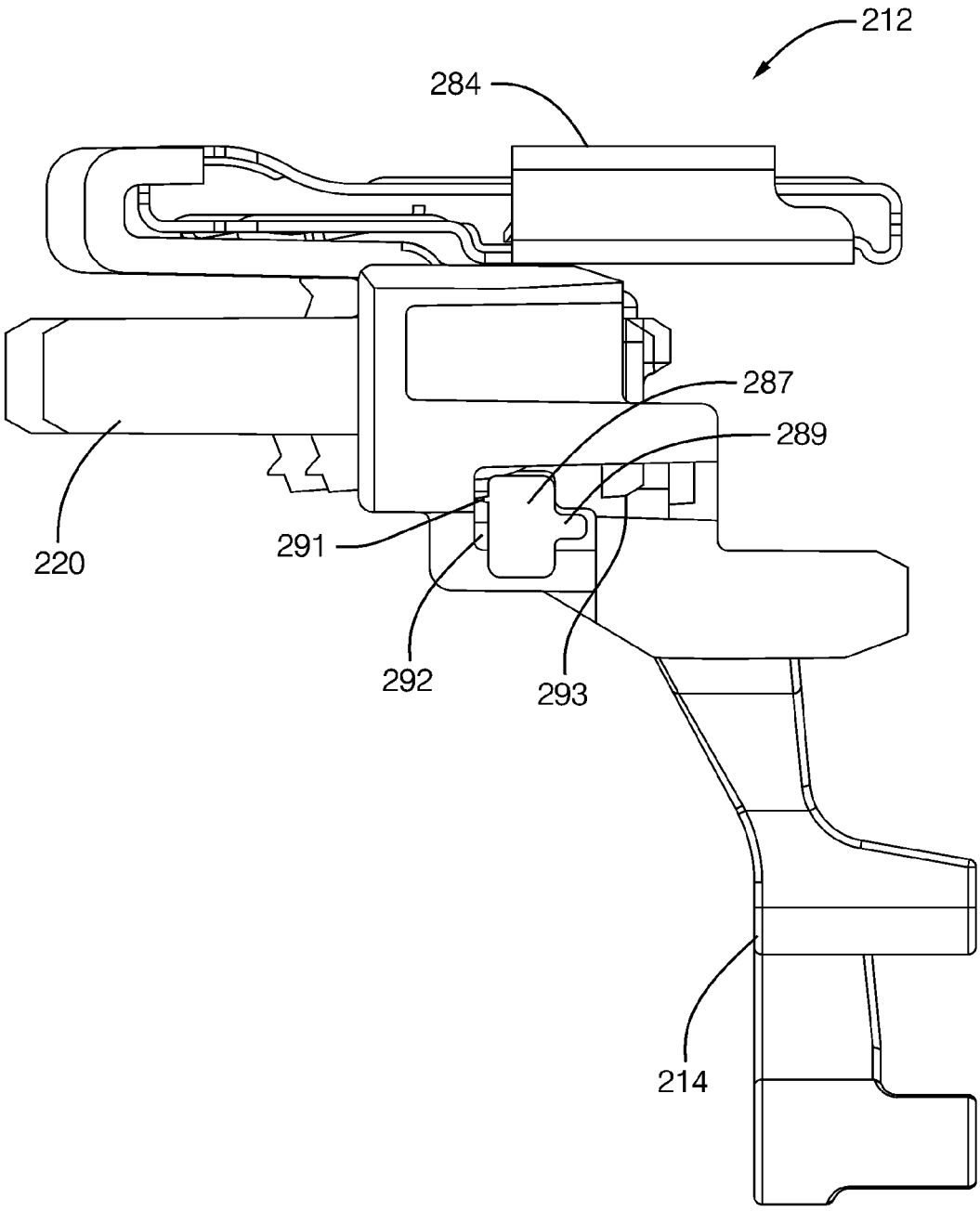
FIG. 18 shows a side view of the arrangement of FIG. 17, showing details thereof.

Referring to FIGS. 17 and 18, retainer pin 286 is used to further secure female connectors 220*a-c* to support frame 214. Retainer pin 286 has a length $L_3$ and includes an index rib 289, a pin retention feature 290, and a crush rib 291. Retainer pin 286 is insertable in a cavity 292 formed in support frame 214 that communicates with retention feet 293 on each of plurality of coupled female connectors 220*a-c*. Index rib 289 is disposed along a length $L_3$ of retainer pin 286 and is used to ensure retainer pin 286 is inserted in support frame 214 in a single orientation. Retainer pin 286 fits along length $L_1$" of support frame 214 to communicate with receptacles 218*a-c*. Length $L_1$ of support frame 214 is greater than length $L_3$ of retainer pin 286. Crush rib 291 is useful to force retainer pin 286 after insertion in cavity 292 in an opposing direction away from crush rib 291 against a portion of support frame 214 in cavity 292 to ensure a tight retention fit for female connectors 220*a-c* and eliminate the potential for female connectors 220*a-c* to have undesirable rattle noise when employed in the electrical configuration. For instance, this feature may be very important to prevent rattle when the electrical connection system is employed in a vehicle electrical circuit application.

Figure 19:
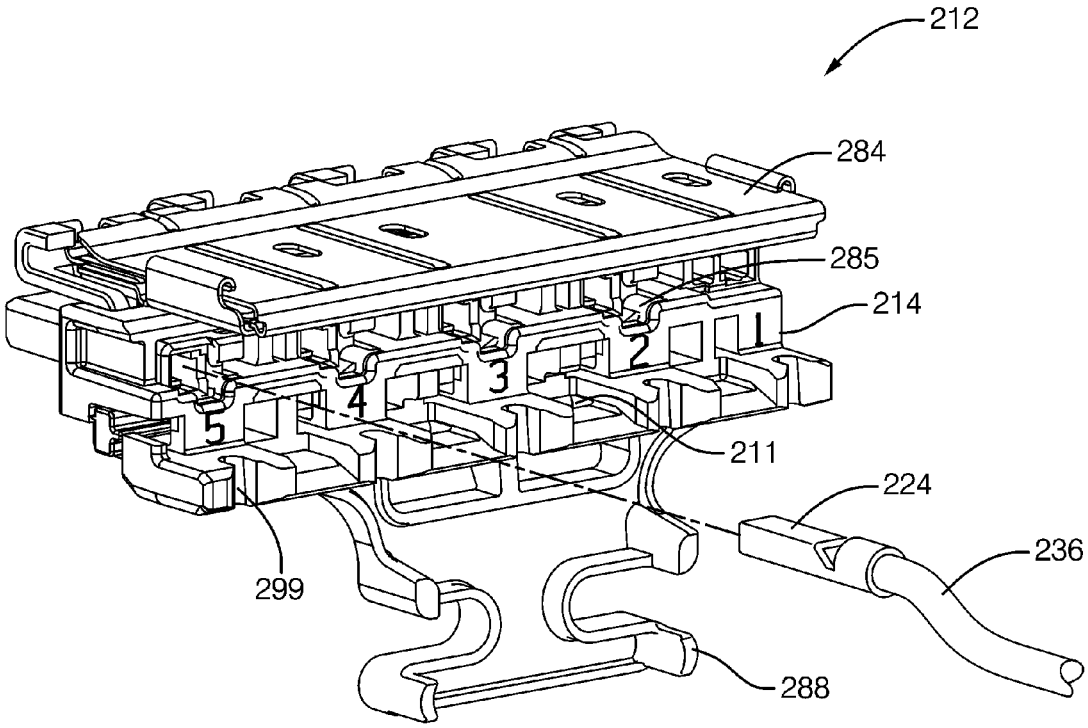
FIG. 19 shows a rear-side, frontal view of the arrangement of FIG. 14, showing insertion of female terminals into the coupled first connectors.
Figure 20:
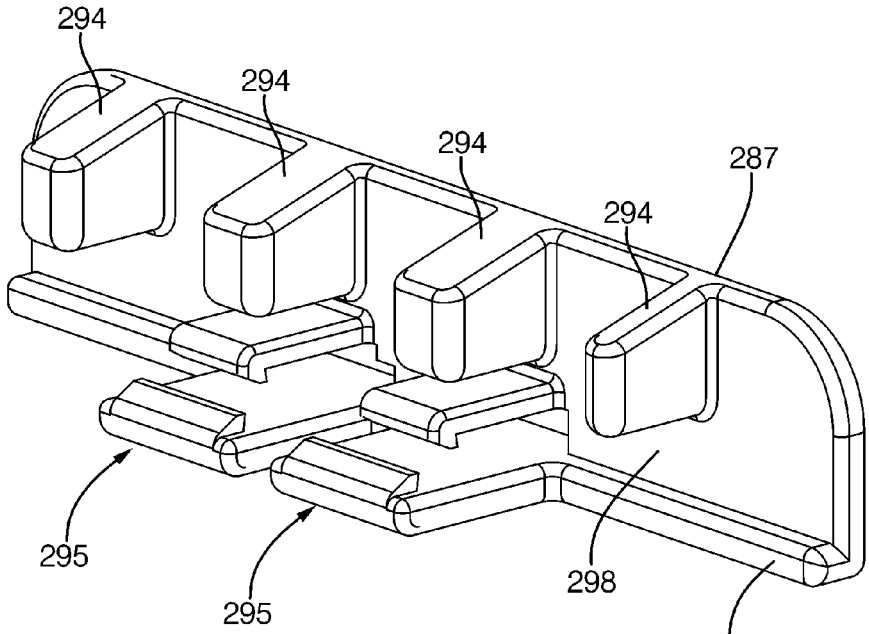
FIG. 20 shows a rear-side, right-hand view of a wire retainer for the arrangement of FIG. 19.
Figure 21:
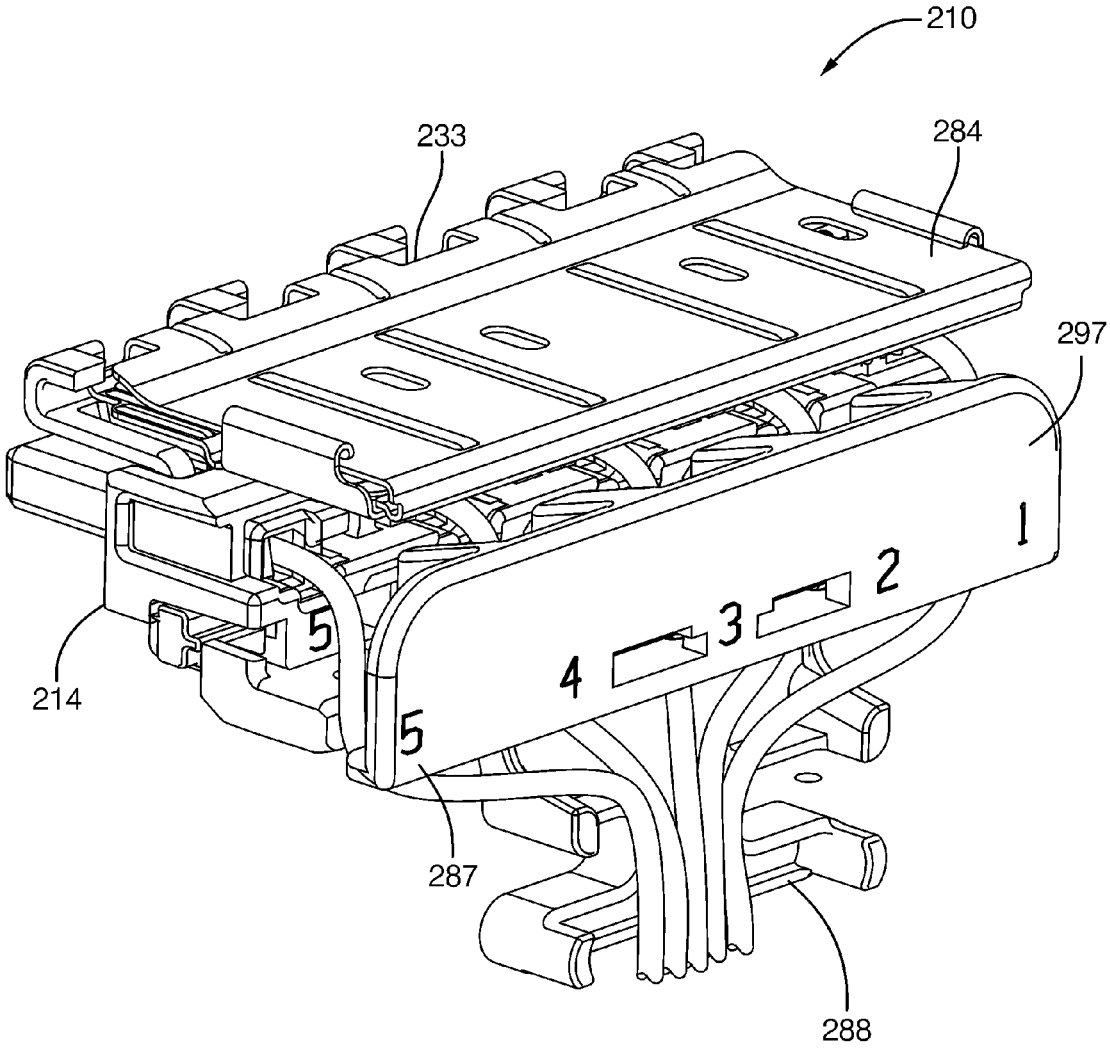
FIG. 21 shows the wire retainer of FIG. 20 attached to the arrangement of FIG. 19.
Figure 22:
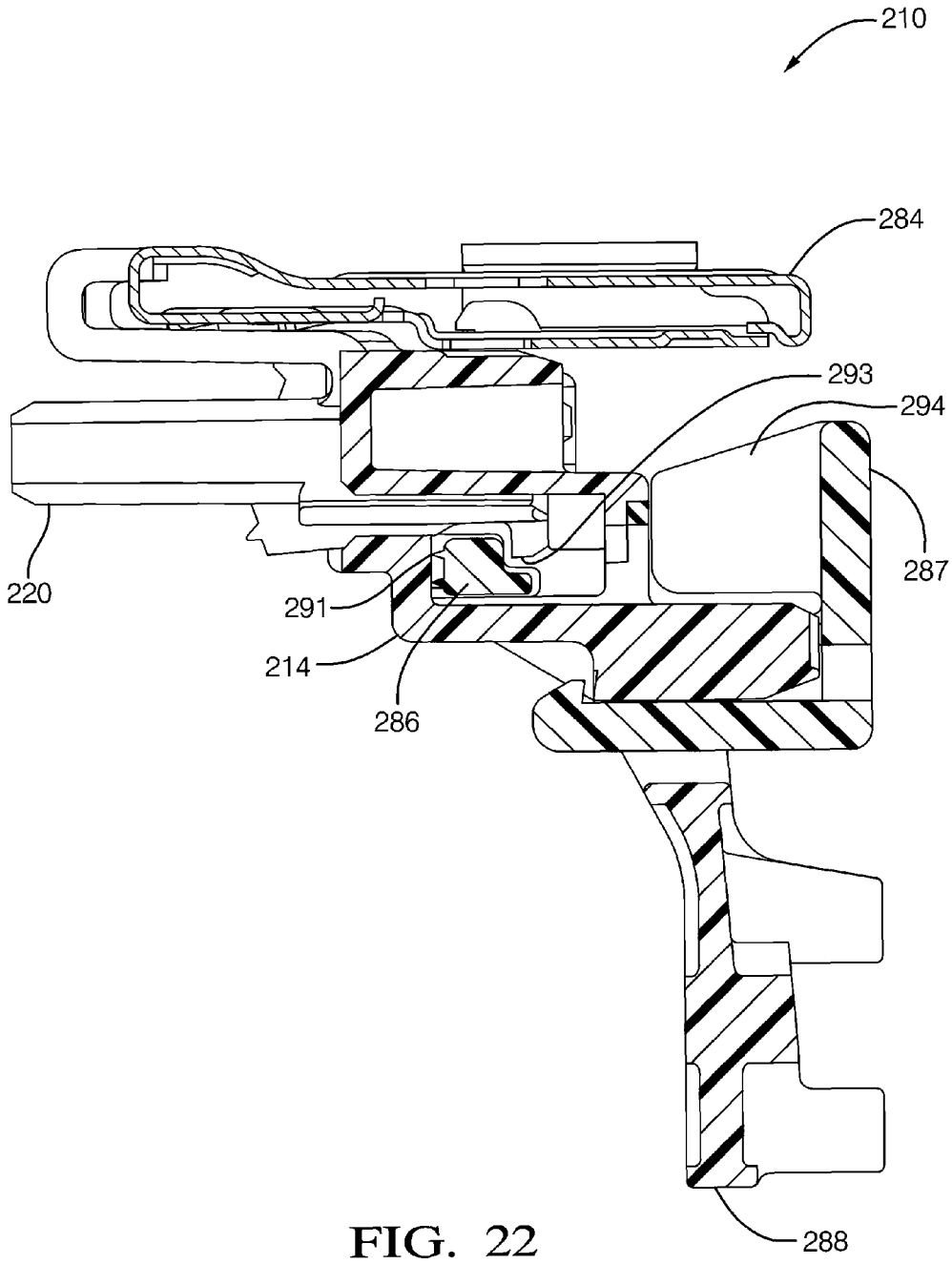
FIG. 22 shows a cross section view of the arrangement of FIG. 21, showing details thereof.

Referring to FIGS. 19-22, wire conductor retainer 287 includes push pads 294, opposing locks 295, wire conductor retaining rail 296, a front face 297, and a rear face 298 opposing front face 297. Push pads 294 and locks 295 extend from rear face 298. Wire conductor retainer 287 is attached to support frame 214 so that push pads 294 abut support frame 214 and fit in a space in-between each receptacle in plurality of receptacles 216*a-c* to assist to limit undesired rocking motion of electrical connection system 210, as previously described herein. Opposing locks 295 communicate and connect with openings 209 in a clam shell-type manner to secure retainer 287 in support frame 214. When retainer 287 is attached to support frame 214, front face 297 serves as a push pad to stabilize and maneuver support frame 214 and female connectors 220 to mate with male connectors 222. Terminals 224 are inserted and fitted into forward section cavity 240*c* of female terminals 220 to reside in forward and rearward sections 272, 273 of cavities 240*a*, 240*c*, as best illustrated in FIG. 19. When wire retainer 287 is attached to support frame 214 using opposing locks 295, rail 296 abuts frame wire slots 299 to retain wire conductors 236 in frame wire slots 299. Retainer 287 assists to stabilize arrangement 212 and prevent undesired rocking motion to arrangement 212 during assembly of arrangement 212 in an electrical circuit application. Retainer 287 also assists to ensure a smooth mating connection of connectors 220, 222 especially when mating arrangement 212 with a single electrical device employing multiple connector connections.

Figure 15:
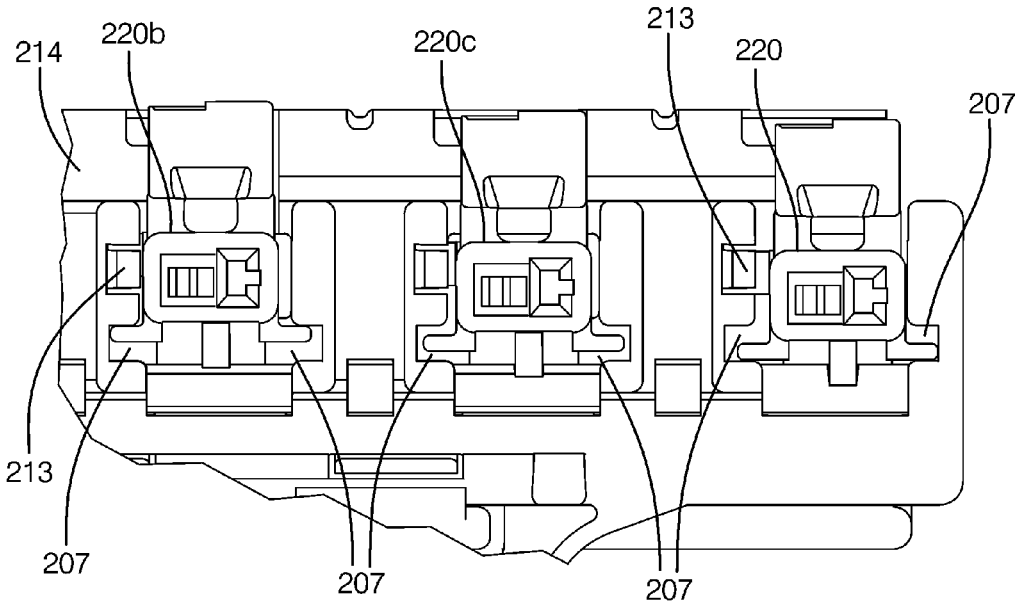
FIG. 15 shows possible float positions of the coupled first connectors in a support frame when mated with second connectors in the electrical connection system of FIG. 14.
Figure 16:
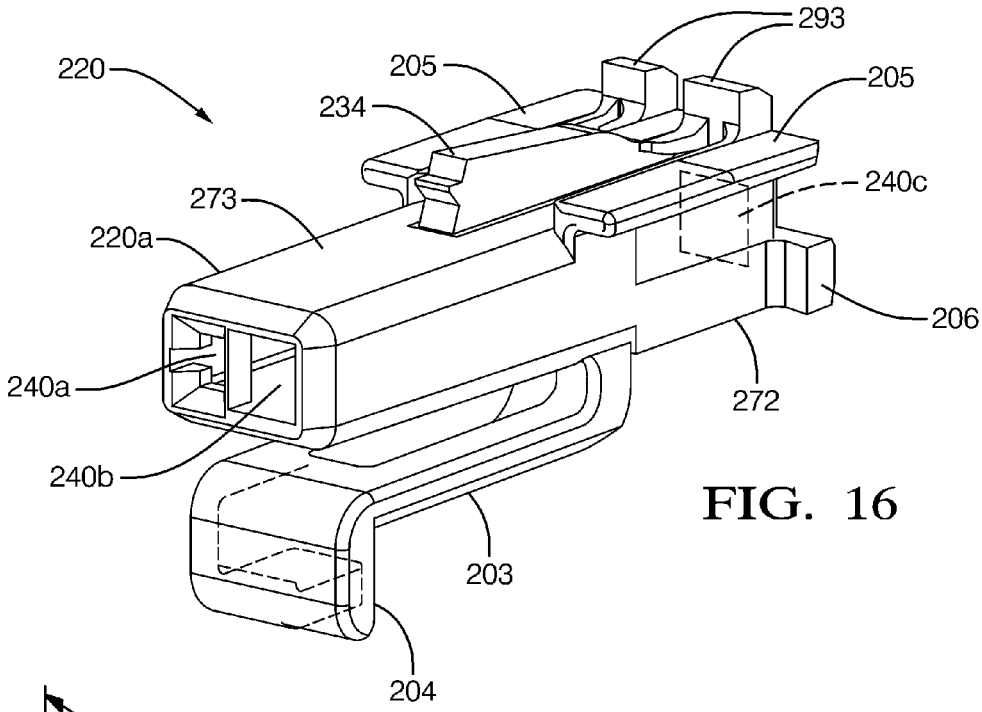
FIG. 16 shows a right-hand view of a first connector of the electrical connection system of FIG. 13.

Referring to FIG. 16, female connector 220*a* includes forward section 272 and rearward section 273. In contrast with the embodiments of FIGS. 1-12, forward section 272 and rearward section 273 are generally axially aligned and are not laterally offset when connectors 220*a*, 222*a* are mated. Female connector 220*a* includes a primary terminal lock (not shown) and a secondary terminal lock 234, as previously described herein. Female connectors 220 are indexed with receptacles 216 as connector rails 205 fit with slots 207 in a single orientation, as best illustrated in FIG. 15. A lock arm 203 is formed in a general U-shape that extends from an exterior surface of female connector 220*a*. A portion of lock arm 203 is a face 204 disposed distally on lock arm 203 from the exterior surface of female connector 220*a*. Face 204 is adapted to oppose a protrusion wall 233 of CPA member 284 to prevent male connector 222*a* from prematurely unmating from female connector 220*a*. Female connector 220*a* also includes retention feet 293 that communicate with retainer pin 286, as previously discussed herein. Two laterally-disposed connector rails 205 on female connector 220*a* are axially inserted in two corresponding axial slots 207 in receptacles 216 when female connectors 220 are receivably coupled in receptacles 216. When female connectors 220*a-c* are receivably coupled in receptacles 216, shoulders 206 urge against flexible lock 203 so as to deflect flexible lock 208 until shoulders 206 move past flexible lock 203 and flexible lock deflects back to a position so as to lock and seat female terminal 220 in receptacle 216. Connector rails 205 and slots 207 are suitably and sufficiently sized based on the predetermined positional mating tolerance variation that needs to be absorbed by receptacles 216. Referring to FIG. 15, while coupled female connectors 220*a-c* have floatable movement about slots 207 in a similar manner as connectors 20, 120 float in keyholes in the embodiment as shown in FIG. 4. Female terminal 220*b* is shown positioned in slots 207 in a top/left position, female terminal 220*c* is shown positioned in slots 207 in a central position, and the female terminal 220 on the left portion of FIG. 15 is shown positioned in slots 207 in a bottom/right position. Flexible terminal locks (not shown) lock in female terminals 224 in female connectors 220 so terminals 224 remain secured in female connectors 220. Connectors 220, 222 are made of similar material as female connectors 20, 22 in the embodiment of FIGS. 1-10.

When arrangement 212 is ready for assembly in an electrical circuit application retaining pin 286 is inserted in cavity 292 after female connectors 220 are received in slots 207 of support frame 214. Wire conductor retainer 287 is also installed preferably have the connectors 220, 222 have been mated and wire conductors 236 dressed. These additional assembly steps are performed in addition to those described in the embodiment of FIGS. 1-10.

In another alternate embodiment, the slotted space defined in the support frame of the embodiment of FIGS. 1-10 may be larger than a thickness of the flange in an axial direction that may allow some amount of Z-axis movement of the female connector relative to the receptacle which would accommodate some amount of Z-axis positional mating tolerance variation of the female connector in relation to the male connector when the male and female connectors are mated.

In a further alternate embodiment, the support frame may be designed to receive a male connector, and the header on the coupled male connector may receive a female connector along the mating axis.

In another alternate embodiment, the support frame may accommodate any number of receptacles. Still alternately, additional rows of receptacles may be added such that the support frame accommodates a plurality of rows of receptacles.

In a further alternate embodiment, the integrated lock arm is not used and in another embodiment the fixed female connector attached to the support frame is not used. In yet other alternate embodiments, more than one fixed female connector attached to the support frame may be used. In yet other alternate embodiments, a fixed male connector or a plurality of fixed male connectors may be attached. The fixed male connectors may or may not include the integrated lock arm. In yet other embodiments, the integrated lock arm may or may not be integral to the support frame. When the lock arm is not integral with the support frame, the lock arm may be attached to the support frame with any suitable fastener.

In yet a further alternate embodiment, the keyholes defined in the first and second rail may be laterally offset in a direction perpendicular to the mating axis when the coupled female connector is mated to the male connector. The received connector coupled in the receptacles would also need to be further modified to fit this offsetting keyhole receptacle configuration.

Thus, a robust electrical connection system that allows positional mating tolerance variation between multiple connectors in the electrical connection system to be absorbed within the electrical connection system has been presented. The electrical connection system is particularly effective for absorbing positional mating tolerance where ganged connectors are utilized, such as may be the case when the electrical connection system is connected to a single electrical device that uses a ganged connection system. The ganged connectors may also be mated in a single-movement, smooth mating connection. The electrical connection system may absorb positional mating tolerance variation in an X-axis or a Y-axis direction. The electrical connection system may also absorb positional mating tolerance variation in the X-axis and the Y-axis and the Z-axis direction. The receptacles in an arrangement allow float movement to absorb the positional mating tolerance variation about the mating axis of the receptacle. A spring in communication with each receptacle disposed on the support frame absorbs Z-direction positional mating tolerance variation. The electrical connection system attains high quality electrical connections while simultaneously absorbing any amount of predetermined tolerance mating variation as multiple connectors in the electrical connection system are mated. The electrical connection system may be employed in an electrical application being generally unaffected by the number of mating devices in the mating device arrangement. The support frame includes a first rail and a second rail. The first and the second rail are formed as single unitary piece with the support frame that simplifies the parts count of the arrangement while providing for improved reliability of the electrical connection system. The key holes formed in the rails of the receptacle effectively assimilate the required connector positional mating tolerance variation in X-axis direction and/or Y-axis direction surrounding the mating axis for a respective receptacle of the electrical connection system. The arrangement is easily assembled with the female connectors being easily inserted and receivably coupled in the support frame by a human operator or by automatic machine placement. The support frame is sufficiently resilient to allow easy insertion of the female connectors for coupling in the respective receptacles. The slot defined between the rails of the support frame allows a flange on the female connector to fit the slot so that the rails, the flange, and the slotted space prevent Z-axis floatable movement where the Z-axis is co-axial with the mating axis. A molded, fixed female connector having a fixed position in the support frame allows easier alignment of the remaining female connectors with corresponding ganged male connectors and ensures a smooth mating process of the ganged male connectors to the coupled female connectors. The ganged male connectors may be mated to the coupled female connectors in a smooth, interrupted mating connection with a single applied force applied against one of the plurality of connectors towards the other plurality of connectors. This may be facilitated with the force applied against a face of a wire retainer attached to the support frame. The electrical connection system may be used in any electrical application that includes multiple connectors where predetermined positional connector tolerance variation is present and needs to be absorbed so that the female and male connectors are smoothly and effectively mated. The keyholes have open ends that allow the receptacles to receive the female connectors in the receptacles in a direction perpendicular to the mating axis. The female connector is moveably secured in the receptacles without further component pieces to secure the female connectors in the support frame. The female connector is constructed to allow a single, keyed orientation of the female connector into the receptacle. The electrical connection system may be also be particularly effective for electrically connecting individual battery cells of a battery stack in an electric-type vehicle having predetermined positional tolerance variation across the battery cells where the battery stack may be connected through the electrical system to one or more electrical devices. The battery stack may be efficiently and smoothly mated to the electrical connection system while any predetermined positional mating tolerance variation within the individual battery cells is absorbed by float movement in the electrical connection system. The wire conductors attached to the female connectors have a further strain relief provided as a result of the wire conductors being coupled in clips disposed on the support frame for each wire conductor. The support frame may be configured to include any number of receptacles in one or more rows dependent on the needs of specific electrical circuit application. The support frame and the female and male connectors may be respectively sized to accept any AWG size wire as required in an electrical circuit application where the electrical connection system is employed. A CPA member disposed adjacent the row of receptacles ensures the plurality of second connectors mated to the plurality of coupled first connectors do to not prematurely unmate from each other which provides further reliability and robustness for the electrical connection system. A retainer pin in communication with the first, or female connectors and receptacles of the support frame provides an additional securing feature that keeps the coupled female connectors attached to the support frame. The retainer pin and the wire retainer assist to help the electrical connection system from having undesired physical rocking motion of the electrical connection system when the electrical connection system is further assembled in an electrical application.

While this invention has been described in terms of the embodiments presented herein, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A electrical connection system comprising:

an arrangement defining a plurality of receptacles and including a plurality of first connector housings respectively including at least one electrical contact, said plurality of first connector housings being receivably coupled in the plurality of receptacles; and a plurality of second connector housings respectively including at least one electrical mating contact, said plurality of second connector housings and the respective at least one electrical mating contact being matable to the plurality of coupled first connector housings and the respective electrical contacts associated with the plurality of coupled first connector housings along mating axes, and the plurality of coupled first connector housings have respective floatable movement in the respective plurality of receptacles that absorb positional mating tolerance variation during mating of the plurality of second connector housings to the plurality of coupled first connector housings, said floatable movement in the respective plurality of receptacles occurs in at least one of an X-axis and a Y-axis direction about the respective mating axes orthogonal to the respective mating axes in the respective plurality of receptacles, wherein said positional mating tolerance variation associated with the plurality of second connector housings in relation to the plurality of coupled first connector housings manifested at the plurality of receptacles when the plurality of second connector housings are mated to the plurality of coupled first connector housings is absorbed by the arrangement.

2. The electrical connection system according to claim 1, wherein the plurality of coupled first connectors have a ganged configuration within the arrangement and the plurality of second connector housings and the respective at least one mating electrical contact mate with the plurality of coupled, ganged first connector housings and the respective at least one electrical contact associated with the coupled, ganged first connector housings in a single unimpeded, uninterrupted mating connection.

3. The electrical connection system according to claim 1, wherein the arrangement further includes, a spring attached to the arrangement, wherein said floatable movement in the respective plurality of receptacles occurs in the X-axis and the Y-axis and a Z-axis direction about the respective mating axes in relation to the plurality of receptacles, said Z-axis direction being co-axial to the respective mating axes and said positional mating tolerance variation absorbed by the respective plurality of receptacles in the Z-axis direction is assimilated by said spring.

4. The electrical connection system according to claim 1, wherein the plurality of receptacles are formed in at least one row in the arrangement.

5. The electrical connection system according to claim 1, wherein the plurality of second connector housings are in electrical communication with a single electrical device.

6. The electrical connection system according to claim 1, wherein said arrangement defines at least one slot in communication with the plurality of receptacles, and the at least one slot receives the plurality of first connector housings such that floatable movement of the plurality of coupled first connector housings in the plurality of receptacles is in relation to said at least one slot.

7. The electrical connection system according to claim 6, wherein said at least one slot in the arrangement comprises at least two slots and each receptacle in the plurality of receptacles includes said at least two slots, and the respective plurality of coupled first connector housings have an amount of floatable movement in the respective plurality of receptacles associated with the at least two slots.

8. The electrical connection system according to claim 6, wherein the arrangement comprises a support frame and the support frame is formed of a single unitary piece.

9. The electrical connection system of claim 1, wherein each first connector body in the plurality of first connector housings includes a forward section and a rearward section, said forward section being receivably coupled in a receptacle in the plurality of receptacles, and said rearward section being matable to a second connector housings in the plurality of second connector housings.

10. The electrical connection system according to claim 1, wherein the support frame comprises at least one rail extending from the support frame and the at least one rail defines at least one recess having an area and each of the plurality of first connector housings includes at least one lock ear where at least a portion of the at least one lock ear is contained within the area when the plurality of first connector housings are receivably coupled in the plurality of receptacles, and said floatable movement of the plurality of coupled first connector housings in the plurality of receptacles is bounded by movement of the at least one lock ear within said area.

11. A ganged electrical connection system comprising:

an arrangement defining a plurality of receptacles and including a plurality of first connectors being receivably coupled in the plurality of receptacles; and a plurality of second connectors matable to the plurality of coupled first of the connectors along mating axes, and the plurality of coupled first connectors have respective floatable movement in the respective plurality of receptacles that absorb positional mating tolerance variation during mating of the plurality of second connectors to the plurality of coupled first connectors, said floatable movement in the respective plurality of receptacles occurs in at least one of an X-axis and a Y-axis direction about the respective mating axes orthogonal to the respective mating axes in the respective plurality of receptacles, wherein said positional mating tolerance variation associated with the plurality of second connectors in relation to the plurality of coupled first connectors manifested at the plurality of receptacles when the plurality of second connectors are mated to the plurality of coupled first connectors is absorbed by the arrangement, and wherein the respective plurality of coupled first connectors have floatable movement in the respective plurality of receptacles in the arrangement and the arrangement further includes at least one first connector that is fixedly attached to the arrangement that does not have said floatable movement.

12. The electrical connection system according to claim 1, wherein the arrangement further includes, a connector position assurance (CPA) member attached to the arrangement, wherein when the plurality of second connector housings are mated with the plurality of coupled first connector housings the CPA member is adapted to prevent the plurality of second connector housings from unmating from the plurality of coupled first connector housings.

13. A method for absorbing positional mating tolerance variation during mating of a plurality of first connector housings and a plurality of second connector housings in a electrical connection system, comprising:

using an arrangement defining a plurality of receptacles and the plurality of first connector housings including a respective at least one electrical contact, said plurality of first connector housings are receivably coupled in the plurality of receptacles, and the plurality of second connector housings include a respective at least one mating electrical contact, said plurality of second connector housings and the respective at least one mating electrical contacts being matable to the plurality of coupled first connector housings and the respective at least one mating contacts associated with the plurality of coupled first connector housings along mating axes; and absorbing said positional mating tolerance variation by the arrangement associated with the plurality of second connector housings in relation to the plurality of coupled first connector housings manifested at the plurality of receptacles when the plurality of second connector housings mate to the plurality of coupled first connector housings along the mating axes.

14. The method according to claim 13, wherein the steps in the method include the coupled first connector housings having a ganged configuration in the arrangement, and the plurality of second connector housings and the respective at least one mating electrical contact mate with the plurality of coupled, ganged first connector housings and the respective at least one electrical contact associated with the coupled, ganged first connector housings in a single unimpeded, uninterrupted mating connection.

15. The method according to claim 14, wherein the method further includes, floatably moving the respective plurality of coupled first connector housings in the respective plurality of receptacles that absorb said positional mating tolerance variation during mating of the plurality of second connector housings to the plurality of coupled first connector housings, and said floatable movement of the respective plurality of coupled first connector housings in the respective plurality of receptacles occurs in at least one of an X-axis and a Y-axis direction about the respective mating axes orthogonal to the respective mating axes in the respective plurality of receptacles.

16. The method according to claim 15, wherein the steps in the method further include the arrangement comprising a spring attached to the arrangement, the method further including floatably moving the respective plurality of coupled first connector housings in the respective plurality of receptacles that absorb said positional mating tolerance variation during mating of the plurality of second connector housings to the plurality of coupled first connector housings, and said floatable movement of the respective plurality of coupled first connector housings in the respective plurality of receptacles occurs in the X-axis and the Y-axis and a Z-axis direction about the respective mating axes, said Z-axis direction being co-axial to the respective mating axes and said positional mating tolerance variation absorbed by the respective plurality of receptacles in the Z-axis direction is assimilated by said spring.

17. The method according to claim 13, wherein the steps in the method further include, defining at least one slot in each receptacle in the plurality of receptacles and the plurality of first connector housings being received in the at least one slot, and the step of absorbing the positional mating tolerance variation further includes, floatably moving the respective plurality of coupled first connector housings in relation to the at least one slot to absorb said positional mating tolerance variation at said respective plurality of receptacles.

18. A electrical connection system employed in an electric-type vehicle that includes a battery stack containing a plurality of battery cells where the electrical connection system assimilates positional mating tolerance variation of the plurality of battery cells when the battery stack is electrically connected to the electrical connection system, the electrical connection system, comprising:

an arrangement defining a plurality of receptacles and including a plurality of first connector housings being receivably coupled in the plurality of receptacles; and a plurality of second connector housings matable to the plurality of coupled first connector housings along mating axes, and the plurality of coupled first connector housings have respective floatable movement in the respective plurality of receptacles that absorb said positional mating tolerance variation during mating of the plurality of second connector housings to the plurality of coupled first connector housings, said floatable movement in the respective plurality of receptacles occurs in at least one of an X-axis and a Y-axis direction about the respective mating axes orthogonal to the respective mating axes in the respective plurality of receptacles, wherein said positional mating tolerance variation associated with the plurality of second connector housings in relation to the plurality of coupled first connector housings manifested at the plurality of receptacles when the plurality of second connector housings are mated to the plurality of coupled first connector housings is absorbed by the arrangement.

19. A method of assimilating positional mating tolerance variation of a plurality of battery cells in a battery stack in an electrical connection system where the battery stack and the electrical connection system are employed in an electric-type vehicle, comprising:

using the electrical connection system to assimilate said positional mating tolerance variation in the plurality of battery cells when the plurality of battery cells are electrically connected to the electrical connection system, the electrical connection system including, an arrangement defining a plurality of receptacles and including a plurality of first connector housings being receivably coupled in the plurality of receptacles; and a plurality of second connector housings matable to the plurality of coupled first connector housings along mating axes, and the plurality of coupled first connector housings have respective floatable movement in the respective plurality of receptacles that absorb said positional mating tolerance variation during mating of the plurality of second connector housings to the plurality of coupled first connector housings, said floatable movement in the respective plurality of receptacles occurs in at least one of an X-axis and a Y-axis direction about the respective mating axes orthogonal to the respective mating axes in the respective plurality of receptacles, wherein said positional mating tolerance variation associated with the plurality of second connector housings in relation to the plurality of coupled first connector housings manifested at the plurality of receptacles when the plurality of second connector housings are mated to the plurality of coupled first connector housings is absorbed by the arrangement.

* * * * *